US008844435B2

(12) United States Patent
Kim

(10) Patent No.: US 8,844,435 B2
(45) Date of Patent: Sep. 30, 2014

(54) COMPRESSION-TYPE WASTEBASKET

(71) Applicant: Il Kang Kim, Busan (KR)

(72) Inventor: Il Kang Kim, Busan (KR)

( * ) Notice: Subject to any disclaimer, the term of this patent is extended or adjusted under 35 U.S.C. 154(b) by 71 days.

(21) Appl. No.: 13/678,828

(22) Filed: Nov. 16, 2012

(65) Prior Publication Data

US 2013/0087055 A1 Apr. 11, 2013

Related U.S. Application Data

(63) Continuation of application No. PCT/KR2010/008719, filed on Dec. 7, 2010.

(30) Foreign Application Priority Data

May 29, 2010 (KR) ..... 10-2010-0050698

(51) Int. Cl.

| | |
|---|---|
| ***B30B 1/04*** | (2006.01) |
| ***B65F 1/06*** | (2006.01) |
| ***B65F 1/14*** | (2006.01) |
| ***B65F 1/10*** | (2006.01) |

(52) U.S. Cl.

CPC ..... *B65F 1/1405* (2013.01); *B65F 1/1415* (2013.01); *B65F 1/06* (2013.01); *B65F 1/10* (2013.01); *Y10S 220/908* (2013.01)

USPC ..... 100/240; 100/229 A; 100/246; 100/265; 100/295; 220/908

(58) Field of Classification Search

CPC ..... B30B 9/3053; B30B 9/3021; B65F 1/06; B65F 1/10; B65F 1/1405; B65F 1/1415

USPC ..... 100/226, 227, 228, 229 A, 238, 240, 100/246, 247, 248, 265, 295; 220/222, 260, 220/770, 908

See application file for complete search history.

(56) References Cited

U.S. PATENT DOCUMENTS

| | | | | |
|---|---|---|---|---|
| 3,760,718 | A * | 9/1973 | Adornetto | 100/227 |
| 3,779,157 | A * | 12/1973 | Ross et al. | 100/240 |
| 5,090,309 | A * | 2/1992 | Lai | 100/226 |
| 7,237,480 | B2 * | 7/2007 | Ruddock | 100/226 |
| 7,299,746 | B2 * | 11/2007 | LaPorte | 100/226 |

FOREIGN PATENT DOCUMENTS

| | | | |
|---|---|---|---|
| JP | 07-323397 | A | 12/1995 |
| JP | 3030191 | U | 7/1996 |

(Continued)

OTHER PUBLICATIONS

PCT International Search Report (KR2010/008719), Aug. 5, 2011.

*Primary Examiner* — Jimmy T Nguyen

(74) *Attorney, Agent, or Firm* — Park & Associates IP Law, P.C.

(57) ABSTRACT

A compression-type wastebasket includes: a body which has an opened upper part and a space formed therein in order to accommodate a garbage bag; a body cover which is configured to cover the upper part of the body, wherein an opening unit for connecting the inside and the outside of the body is formed on the central part thereof, a bag fixing unit is formed along the outer girth of the opening unit to fix the girth of an inlet end portion of the garbage bag, and a gripping unit is formed on a part of the opening unit; and a compression member which has a compression surface capable of entering the opening unit in order to compress the waste contained within the body, and is configured to be gripped on the gripping unit while rotating at a predetermined angle on the basis of a compression direction in the opening unit.

16 Claims, 19 Drawing Sheets

(56) References Cited

FOREIGN PATENT DOCUMENTS

| | | | |
|---|---|---|---|
| JP | 3040810 | U | 6/1997 |
| JP | 3041870 | U | 7/1997 |
| JP | 10-025002 | A | 1/1998 |
| JP | 3065586 | U | 10/1999 |
| KR | 20-1998-0010422 | A | 5/1998 |
| KR | 10-2010-0009920 | A | 1/2010 |

* cited by examiner

COMPRESSION-TYPE WASTEBASKET

REFERENCE TO RELATED APPLICATIONS

This is a continuation of pending International Patent Application PCT/KR2010/008719 filed on Dec. 7, 2010, which designates the United States and claims priority of Korean Patent Application No. 10-2010-0050698 filed on May 29, 2010, the entire contents of which are incorporated herein by reference.

FIELD OF THE INVENTION

The present invention relates to a compression-type wastebasket, and more particularly, to a compression-type wastebasket that is capable of compressing waste in a garbage bag mounted thereinto and tying the garbage bag in the state where the waste has been compressed so as to remove the garbage bag therefrom.

BACKGROUND OF THE INVENTION

So as to reduce a quantity of waste generated from households, generally, separate garbage bags are made and sold by self-governing bodies in many regions.

Since the garbage bags currently used are charged, accordingly, most of users forcedly push a large amount of waste into the garbage bags to reduce the number of garbage bags consumed. In this state, however, it is not easy to tie the garbage bag, and further, since the garbage bag is made of relatively thin vinyl, it is torn with ease.

To solve the above-mentioned problems, thus, a variety of wastebaskets in which the compression for the waste charged in the garbage bag is carried out have been proposed and supplied in the market. According to the conventional compressible wastebaskets, an inside casing is first inserted into the garbage bag, and an outside casing is then fitted around the garbage bag. Next, a cover is pressed to compress the waste in the inside casing.

If the inside casing inserted into the garbage bag is drawn to remove the garbage bag after the use from the wastebasket, the waste attached to or contacted with the inside casing is drawn together with the inside casing. Accordingly, the compressed waste becomes swollen or exceeds over the garbage bag.

Even when the upper portion of the garbage bag is tied up to throw the garbage bag away, further, the waste should be kept compressed. According to the conventional compressible wastebaskets, however, the compressed waste is restored to its original state in the process of tying the garbage bag, thereby making it difficult to tie the garbage bag and further reducing the compression effects of the waste.

SUMMARY OF THE INVENTION

Accordingly, the present invention has been made in view of the above-mentioned problems occurring in the prior art, and it is an object of the present invention to provide a compression-type wastebasket that is capable of compressing waste in a garbage bag mounted thereinto and tying the garbage bag in the state where the waste has been compressed.

It is another object of the present invention to provide a compression-type wastebasket that is capable of compressing waste in a garbage bag mounted thereinto even though the quantity of waste exceeds the capacity of the garbage bag, thereby economically reducing the number of garbage bags used.

To accomplish the above objects, according to a first aspect of the present invention, there is provided a compression-type wastebasket including: a body having a space formed thereinto to accommodate a garbage bag thereinto in such a manner as to be open at the upper portion thereof; a cover adapted to cover the upper portion of the body and having an opening unit formed at the center thereof in such a manner as to allow the inside of the body to communicate with the outside, a bag fixing unit formed along the outer periphery of the opening unit to fix the periphery of the inlet end portion of the garbage bag, and a gripping unit formed on a portion of the opening unit; and a compression means having a compression surface adapted to freely enter the opening unit to compress the waste charged into the garbage bag, the compression means adapted to be engaged with the gripping unit when rotated to a given angle around a compression direction on the opening unit.

According to the present invention, preferably, the gripping unit is formed of gripping protrusions protruded toward the center of the opening unit from the portions of the inner periphery of the opening unit, and the compression means has gripping grooves into which the gripping protrusions are fittedly inserted, thereby being engaged with the gripping unit.

According to the present invention, preferably, the gripping unit is formed of gripping grooves formed on the portions of the inner periphery of the opening unit, and the compression means has gripping protrusions adapted to be fittedly inserted into the gripping grooves, thereby being engaged with the gripping unit.

According to the present invention, preferably, the bag fixing unit includes: a round bag fixing rim protruded from the outer periphery of the opening unit; and a round fastening rim adapted to be fastened to the bag fixing rim in such a manner as to fix the periphery of the inlet end portion of the garbage bag thereto.

According to the present invention, preferably, the cover includes: a cover plate mounted on the upper side of the body; and an upper casing mounted on the upper side of the cover plate, and the bag fixing unit includes: a portion of the upper casing; and a fastening member adapted to be fastened to the portion of the upper casing.

According to the present invention, preferably, the fastening member is fastened to the portion of the upper casing by means of spiral coupling.

To accomplish the above objects, according to a second aspect of the present invention, there is provided a compression-type wastebasket including: a frame; an upper body adapted to be mounted on the frame and having an opening unit formed at the center thereof, a bag fixing unit formed along the outer periphery of the opening unit to fix the periphery of the inlet end portion of a garbage bag, and a gripping unit formed on a portion of the opening unit; and a compression means having a compression surface adapted to freely enter the opening unit to compress the waste charged into the garbage bag, the compression means adapted to be engaged with the gripping unit when rotated to a given angle around a compression direction on the opening unit.

According to the present invention, preferably, the gripping unit is formed of gripping protrusions protruded toward the center of the opening unit from the portions of the inner periphery of the opening unit, and the compression means has gripping grooves into which the gripping protrusions are fittedly inserted, thereby being engaged with the gripping unit.

According to the present invention, preferably, the gripping unit is formed of gripping grooves formed on the portions of the inner periphery of the opening unit, and the compression means has gripping protrusions adapted to be fittedly inserted into the gripping grooves, thereby being engaged with the gripping unit.

According to the present invention, preferably, the upper body has an upper casing, and the bag fixing unit has a portion of the upper casing; and a fastening member adapted to be fastened to the portion of the upper casing.

To accomplish the above objects, according to a third aspect of the present invention, there is provided a compression-type wastebasket including: a body having a space formed thereinto to accommodate a garbage bag thereinto, an opening unit formed on the upper portion thereof, and a gripping unit formed along a portion of the opening unit; a cover having a shape of a casing communicating with the opening unit in such a manner as to cover the upper portion of the body and having a bag fixing unit adapted to be fastened to the periphery of the opening unit to fix the periphery of the inlet end portion of the garbage bag; and a compression means having a compression surface adapted to freely enter the opening unit to compress the waste charged into the garbage bag, the compression means adapted to be engaged with the gripping unit when rotated to a given angle around a compression direction on the opening unit.

According to the present invention, preferably, the gripping unit is formed of gripping protrusions protruded toward the center of the opening unit from the portions of the inner periphery of the opening unit, and the compression means has gripping grooves into which the gripping protrusions are fittedly inserted, thereby being engaged with the gripping unit.

According to the present invention, preferably, the gripping unit is formed of gripping grooves formed on the portions of the inner periphery of the opening unit, and the compression means has gripping protrusions adapted to be fittedly inserted into the gripping grooves, thereby being engaged with the gripping unit.

According to the present invention, preferably, the portions where the gripping protrusions and the gripping grooves are engaged with each other are formed in pairs at the positions facing each other.

According to the present invention, preferably, the compression means has semi-circular both side portions separated by means of a cutting portion having a given width, and the semi-circular both side portions are fixed rigidly by means of a support member disposed on the top surfaces thereof in such a manner as to be engaged at both sides thereof with the gripping unit.

According to the present invention, the compression-type wastebasket has the following advantages:

First, the engaged state of the compression means with the cover or the body is maintained, so that the waste can be kept compressed at the time when the inlet end portion of the garbage bag is tied up, thereby making it convenient to tie the tying portions of the garbage bag and providing a high compression efficiency to increase the quantity of waste charged in the garbage bag.

Second, the round fastening rim or the fastening member is fittedly or spirally coupled to the upper casing, and the inlet end portion of the garbage bag is fixedly fitted to a portion where the coupling is formed, thereby making it easy to fix the garbage bag to the compression-type wastebasket.

Third, the compression-type wastebasket according to the claim 8, which is capable of tying the garbage bag in the state of compressing the waste charged in the garbage bag mounted thereinto, is configured without any separate body, thereby making the whole configuration very simple.

Last, the portions where the gripping protrusions and the gripping grooves are engaged with each other are formed in pairs at the positions facing each other, thereby stably maintaining the engagement state.

DETAILED DESCRIPTION OF THE INVENTION

Hereinafter, an explanation on a compression-type wastebasket according to preferred embodiments of the present invention will be given with reference to the attached drawings.

Figure 1:
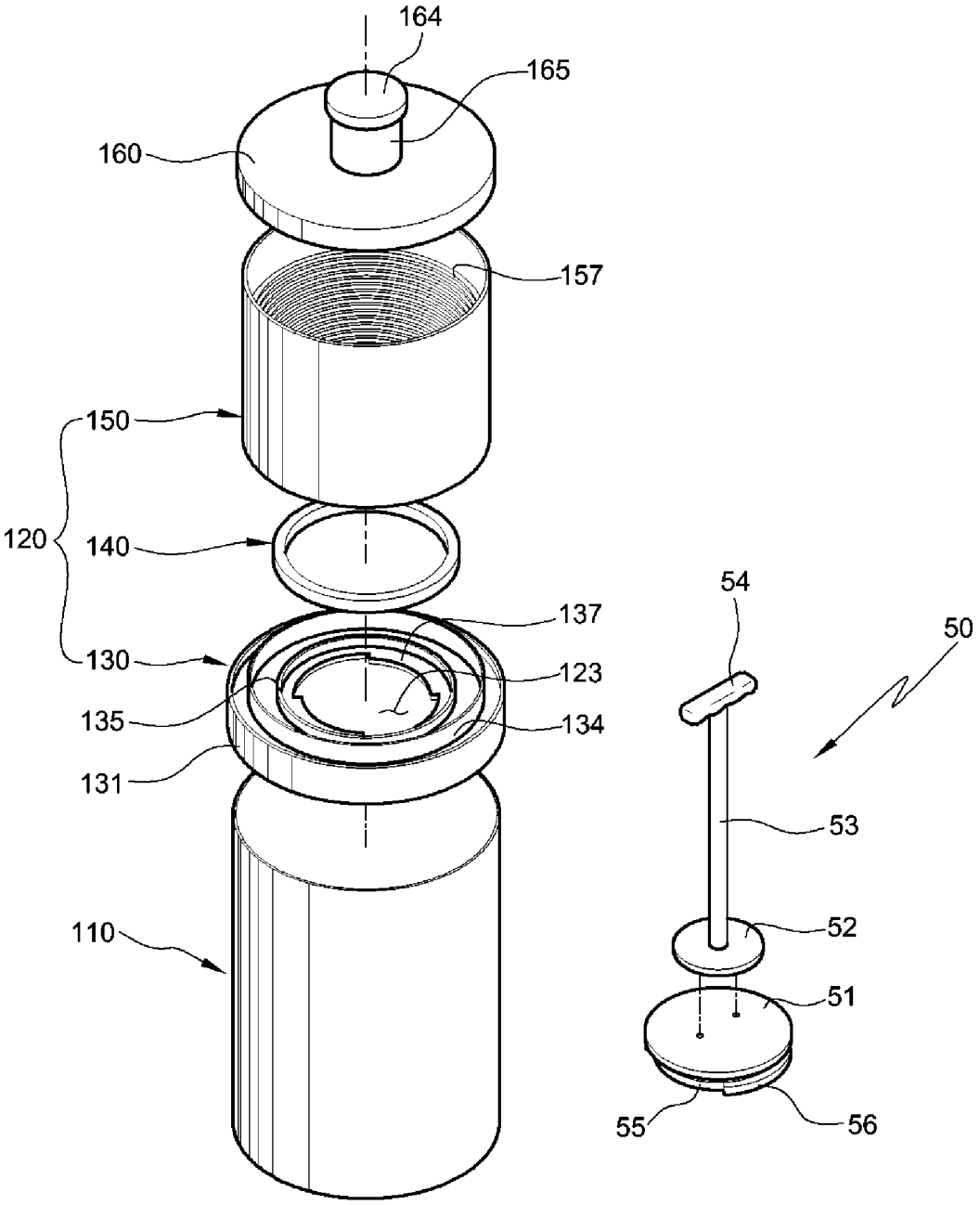
FIG. 1 is a perspective view showing a compression-type wastebasket according to a first embodiment of the present invention.
Figure 2:
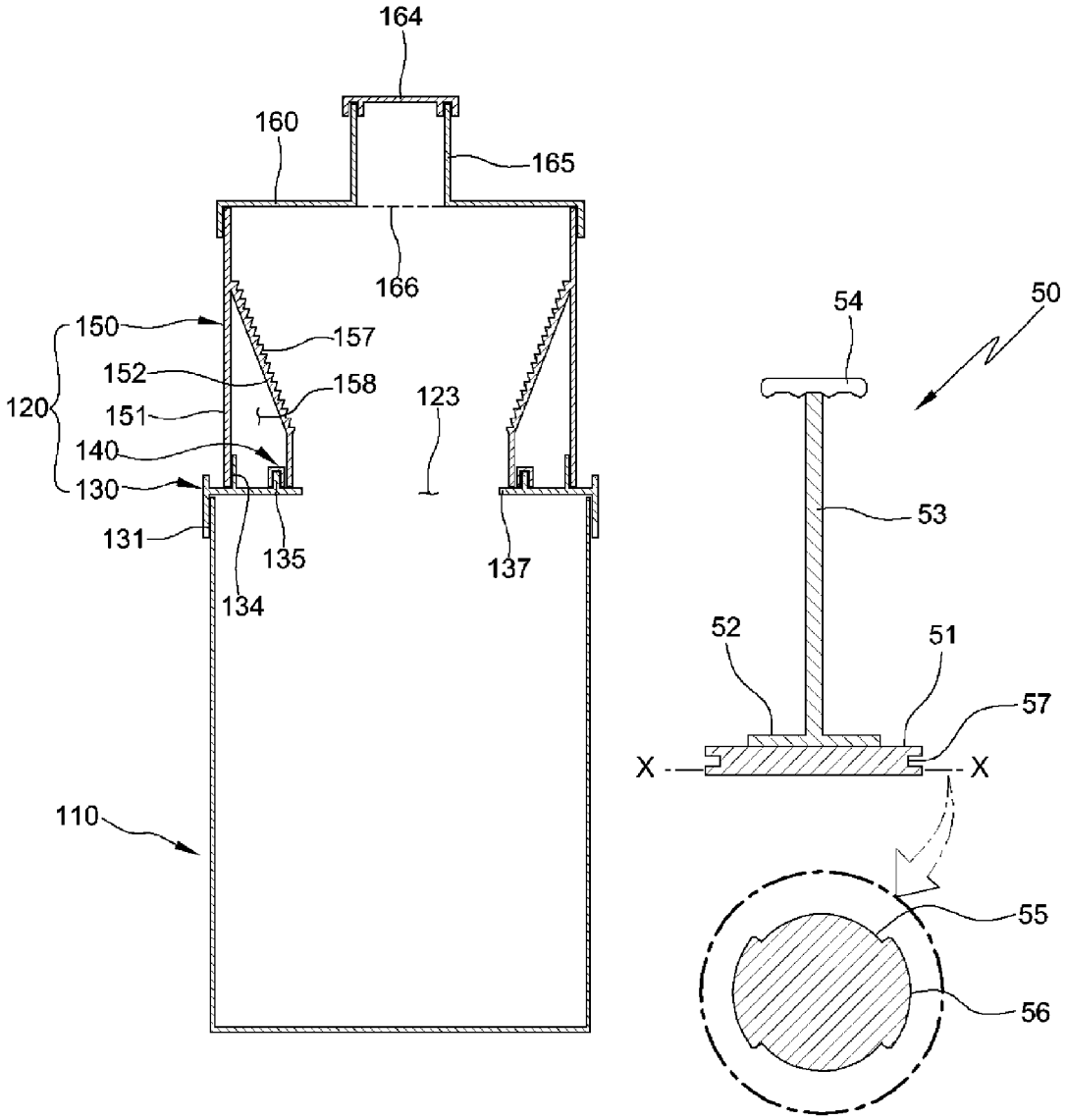
FIG. 2 is a sectional view showing the compression-type wastebasket according to the first embodiment of the present invention.

FIG. 1 is a perspective view showing a compression-type wastebasket according to a first embodiment of the present invention, and FIG. 2 is a sectional view showing the compression-type wastebasket according to the first embodiment of the present invention.

Referring to FIGS. 1 and 2, a compression-type wastebasket according to the first embodiment of the present invention largely includes a body 110, a cover 120 for covering the body 110, and a compression means 50 adapted to compress the waste charged into the body 110.

The body 110 has a given shape capable of accommodating a garbage bag thereinto. Further, the body 110 has a space formed thereinto to correspond to the capacity of a garbage bag accommodated thereinto and is open at the upper portion thereof. The body 110 is desirably formed of a single cylindrical casing whose bottom is closed, but it may have a multiple-angled section or a separable bottom portion. Only if the body 110 accommodates the garbage bag thereinto, the body 110 has no limitation where the inside space should be separated from the outside space. Accordingly, a plurality of bar-shaped members may be mounted circumferentially to support the cover 120 thereagainst. Furthermore, the plurality of bar-shaped members may be replaced with a plurality of arch-shaped members to take a generally cylindrical shape.

The cover 120 largely includes a cover plate 130, a round fastening rim 140 and an upper casing 150.

The cover plate 130 has an opening unit 123 formed at the center thereof, through which the waste is put, and a bag fixing unit is formed along the outer periphery of the opening unit 123. In more detail, the bag fixing unit is formed of a round bag fixing rim 135 protruded upwardly from the cover plate 130, and the bag fixing rim 135 is fastened to the round fastening rim 140 as will be discussed later.

Further, a round upper casing fixing protrusion 134 is formed along the outer periphery of the bag fixing rim 135, and a round body fixing rim 131 is formed along the outer periphery of the upper casing fixing protrusion 134 in such a manner as to be fitted to the top end periphery of the body 110.

The opening unit 123 formed inside the bag fixing rim 135 has a gripping unit 137 formed therealong, with which the compression means 50 as will be explained later is engaged to fixedly grip the inlet end portion of the garbage bag.

Desirably, the gripping unit is formed of a pair of gripping protrusions protruded toward the center of the opening unit 123 from a portion of the periphery thereof. Further, the pair of gripping protrusions 137 faces each other, which allows the compression means 50 to be more stably engaged therewith.

Accordingly, the compression means 50 has gripping grooves 57 into which the gripping protrusions 137 are fittedly inserted. Thus, the inlet end portion of the garbage bag is tightly fitted between the gripping protrusions 137 and the gripping grooves 57, further preventing escaping by means of the friction force therebetween.

Of course, the positions of the gripping protrusions 137 and the gripping grooves 57 may be changed to each other, so that the gripping protrusions 137 are formed on the compression means 50 and the gripping grooves 57 on the cover plate 130.

On the other hand, the round fastening rim 140 is formed of a rubber or a soft synthetic resin and has a groove formed on the underside thereof so as to fit the bag fixing rim 135 thereto. Accordingly, in a state where the inlet end portion of the garbage bag is covered on the bag fixing rim 135, the round fastening rim 140 is fastened to the bag fixing rim 135 to fix the inlet end portion of the garbage bag.

The upper casing 150 is fixedly fitted to the upper casing fixing protrusion 134 formed on the cover plate 130. The upper casing 150 includes an outside casing portion 151 and a guide casing portion 152 formed inside the outside casing portion 151. In this case, the outside casing portion 151 is fixedly fitted to the upper casing fixing protrusion 134. The outside casing portion 151 serves to prevent the inlet end portion of the garbage bag exposed to the outside of the opening unit 123 from being observed to the outside, thereby providing a clean outer appearance. That is, a given space 158 is formed between the outside casing portion 151 and the guide casing portion 152, into which the end portion of the garbage bag is located, thereby preventing the end portion of the garbage bag from being seen to the outside.

The guide casing portion 152 is located inside the round fastening rim 140 and has a tapered portion expanded upwardly, thereby guiding the waste to the opening unit 123. The tapered portion of the guide casing portion 152 has a plurality of stepped protrusions 157 like stairs formed therealong. A deodorant agent is sprayed on the stepped protrusions 157 and stays thereon, without any application to the interior of the wastebasket, thereby obtaining the deodorizing effects for a long period of time.

Desirably, the cover 120 has a separate upper cover 160 mounted on the top end portion thereof. The upper cover 160 has a grasping portion 165 formed at the center thereof in a shape of a casing having a small diameter in such a manner as to be grasped by a user's hand to open the upper cover 160. The grasping portion 165 has a separate cap 164 mounted thereon and a net 166 mounted on the underside thereof. Accordingly, a sterilizer or deodorant agent is sprayed into the cap 164 and diffused into the body 110 through the net 166.

On the other hand, the compression means 50 has a compression plate 51 on which a compression surface is formed, an auxiliary compression plate 52, a compression bar 53 and a handle 54.

The compression plate 51 is of a round plate having a sectional area freely entering the opening unit 123 of the cover 120. Instead of the round plate, of course, the compression plate 51 may have various shapes. Further, the compression plate 51 has gripping grooves 57 formed along the outer periphery thereof in such a manner as to be fitted to the gripping protrusions 137 formed on the opening unit 123 of the cover 120. As shown in the section taken along the line X-X of FIG. 2, the periphery of the compression plate 51 is divided into portions 56 where the gripping grooves 57 are formed and portions 55 where the gripping grooves 57 are not formed. This causes the fitting to occur when the compression plate 51 is rotated to a given angle. The operation will be explained next. The portions where the gripping protrusions 137 and the gripping grooves 57 are engaged with each other are desirably formed in pairs at the positions facing each other.

Figure 3:
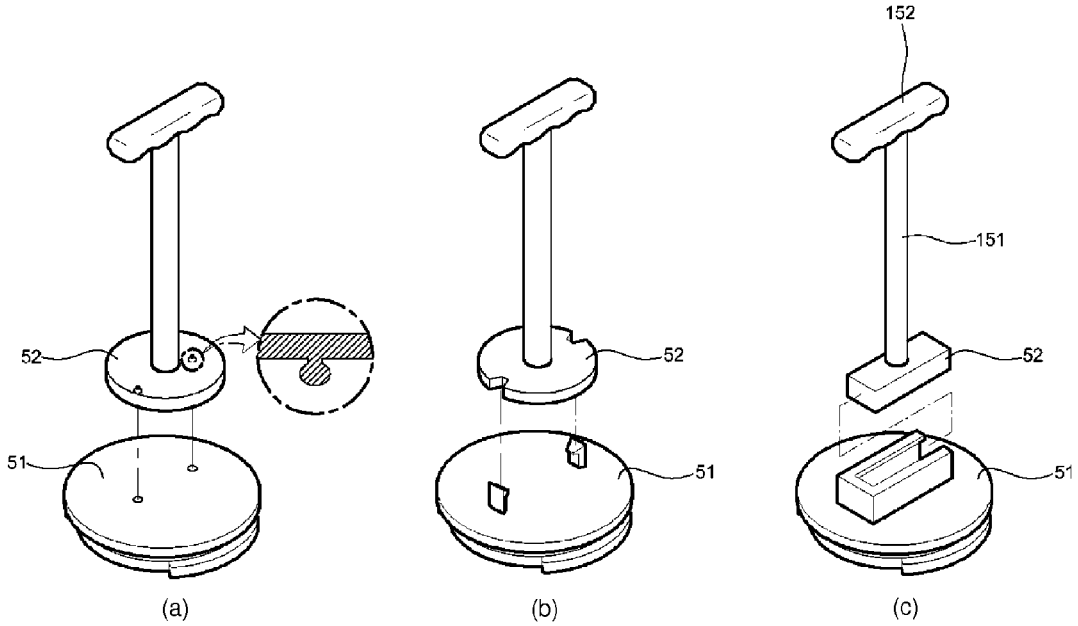
FIGS. 3*a* to 3*c* are perspective views showing various coupling structures between a compression plate and an auxiliary compression plate of a compression means according to the first embodiment of the present invention.

The compression plate 51 is used to tie the inlet end portion of the garbage bag if it is desired to throw the garbage bag away. Moreover, the auxiliary compression plate 52 is used to compress the waste in the state where the garbage bag disposed in the wastebasket of the invention, whenever the compression is needed. The auxiliary compression plate 52 has a relatively small compression surface, so that it can easily enter the opening unit 123 and compress the waste against the garbage bag. FIGS. 3*a* to 3*c* are perspective views showing various coupling structures between the compression plate 51 and the auxiliary compression plate 52 of the compression means 50 according to the first embodiment of the present invention.

Figure 4:
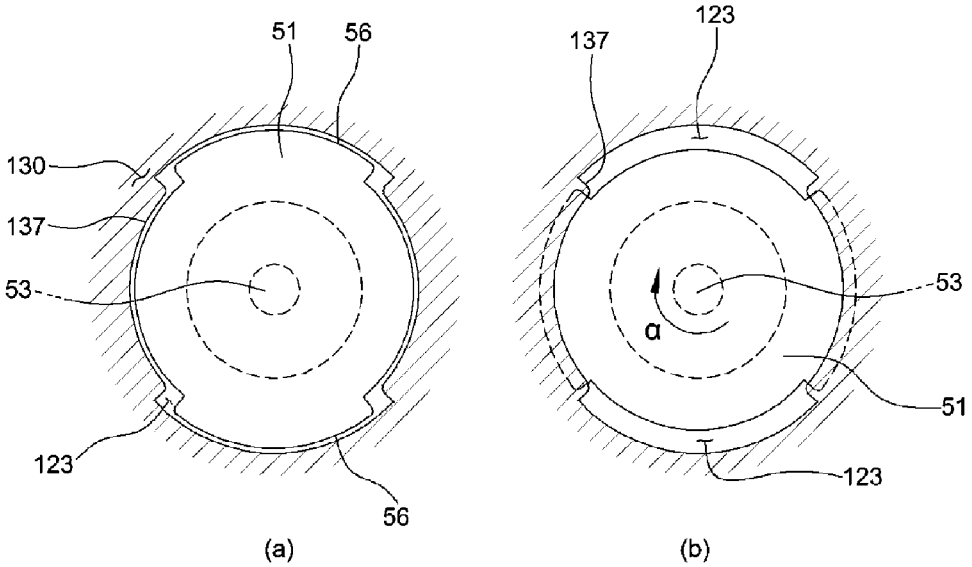
FIGS. 4*a* and 4*b* are top views showing the operations where the compression means is engaged with gripping protrusions of a cover plate according to the first embodiment of the present invention.

On the other hand, FIGS. 4*a* and 4*b* are top views showing the operations where the compression means 50 is fitted to the gripping protrusions of the cover plate 130 according to the first embodiment of the present invention.

FIG. 4*a* shows the state where the compression plate 51 of the compression means 50 is positioned into the opening unit 123 of the cover 120. The portions 56 of the compression plate 51 where the gripping grooves 57 are formed are inserted into the space of the opening unit 123 where the gripping protrusions 137 are not formed, thereby locating the gripping protrusions 137 and the gripping grooves 57 on the same plane as each other. At this time, the inlet end portion of the garbage bag is exposed through the opening unit 123 and is spread outwardly from the periphery of the opening unit 123. That is, FIG. 4*a* shows the state where the inlet end portion of the garbage bag is fitted to the gap between the cover plate 130 and the compression plate 51.

After that, as shown in FIG. 4*b*, if the compression plate 51 is rotated around the compression bar 53, the gripping protrusions 137 are fitted to the gripping grooves 57 and engaged with each other. Accordingly, the inlet end portion of the garbage bag is fitted between the gripping protrusions 137 and the gripping grooves 57, so that it does not fall down by means of the friction force occurring through the fitting.

Under the above-mentioned operation, a method for using the garbage bag through the compression-type wastebasket according to the first embodiment of the present invention will be explained.

Figure 5:
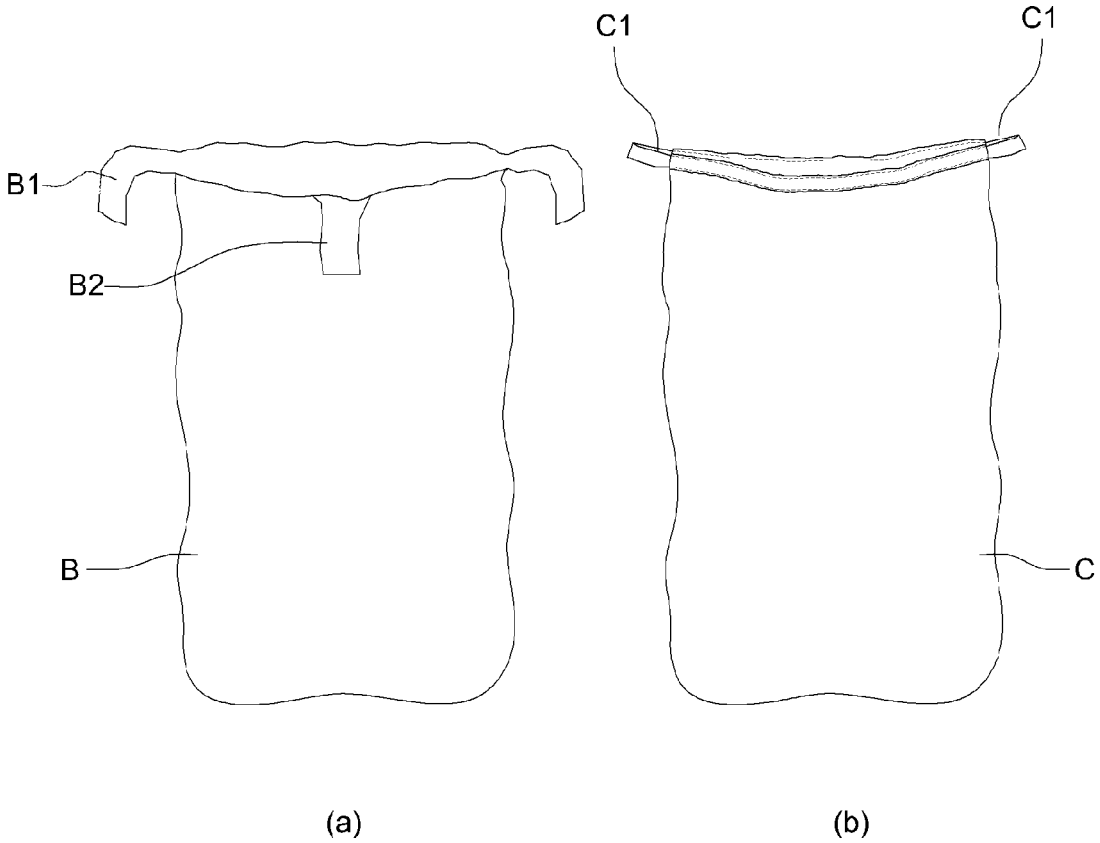
FIGS. 5*a* and 5*b* are exemplary views showing the kinds of the garbage bags mounted in the compression-type wastebasket of the present invention.

FIGS. 5*a* and 5*b* are exemplary views showing the kinds of the garbage bags mounted in the compression-type wastebasket of the present invention.

FIG. 5*a* shows a garbage bag B having four tying portions B1 and B2 formed on the inlet end portion thereof, and FIG. 5*b* shows a garbage bag C having a tying string C1 embedded along the inlet end portion thereof, such that if the tying string C1 pulls, the inlet end portion of the garbage bag is tied.

First, as shown in FIG. 5*a*, a state will be explained wherein the garbage bag B having the four tying portions B1 and B2 formed on the inlet end portion thereof is applied to the compression-type wastebasket of the present invention.

Figure 6:
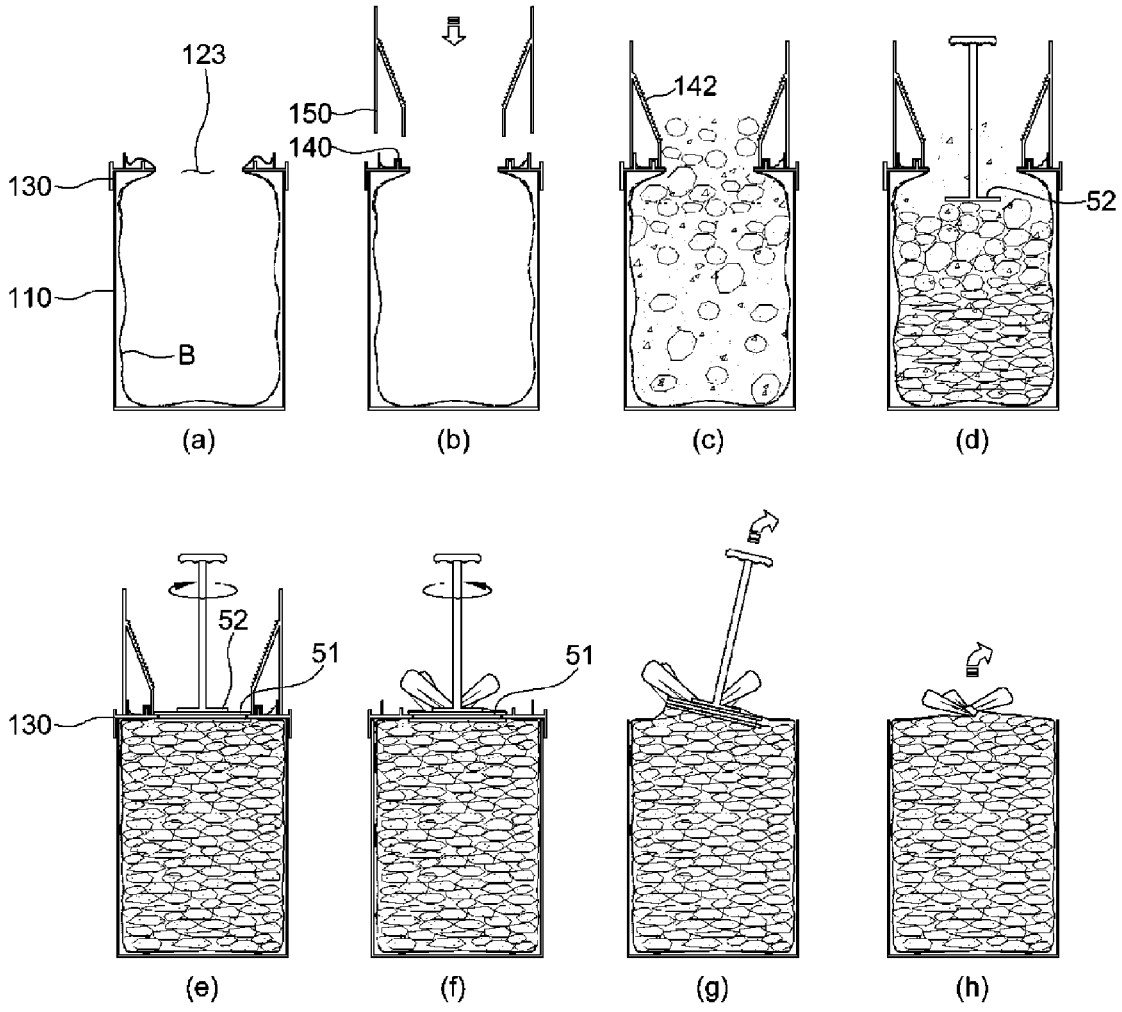
FIGS. 6*a* to 6*h* are sectional views showing the usage processes of the compression-type wastebasket according to the first embodiment of the present invention applied to the garbage bag of FIG. 5*a*.

As shown in FIG. 6*a*, in a state where the upper casing 150 is separated from the body 110 the garbage bag B is insertedly put into the body 110. At this time, the inlet end portion of the garbage bag B, that is, the tying portions B1 and B2 are exposed through the opening unit 123 of the cover 120 and next spread outwardly from the periphery of the opening unit 123.

FIG. 6*b* shows the process wherein after the round fastening rim 140 is fastened to the bag fixing rim 135 of the cover plate 140 in the state where the garbage bag B has been mounted on the wastebasket, the body 110 is coupled to the upper casing 150. The fastening of the round fastening rim 140 enables the inlet end portion of the garbage bag B to be rigidly fixed, and the upper casing 150 is thus coupled to the fixed portion of the garbage bag B. Accordingly, the exposed portion of the inlet end portion of the garbage bag B to the upper portion of the cover 130 is located between the outside casing portion 151 and the guide casing portion 152 of the upper casing 150 and thus not exposed to the outside.

FIG. 6*c* shows the state where waste is charged up to the guide casing portion 152 of the upper casing 150 after the upper casing 150 has been mounted.

After that, if the waste is charged fully to the guide casing portion 152, it is compressed by means of the auxiliary compression plate 52 or the compression plate 51 on which the handle 53 is mounted, as shown in FIG. 6*d*. The compression is carried whenever needed while the wastebasket is being used.

FIG. 6*e* shows the process where the waste is maintained in the state of being compressed before the garbage bag B is tied. In the state where the compression plate 51 is pushed into the wastebasket to compress the waste thereinto, the compression plate 51 is rotated to a given angle and thus fitted to the cover plate 130.

FIG. 6*f* shows the state where the upper casing 150 and the round fastening rim 140 are removed from the body 110 after the compression plate 51 has compressed the waste and next, the garbage bag B is tied up one time. Even though the round fastening rim 140 is removed before the garbage bag B is tied up one time, the inlet end portion of the garbage bag B is fitted between the gripping grooves 57 of the compression plate 51 and the gripping protrusions 137 of the cover plate 130, so that it does not fall down by means of the friction force occurring through the fitting. After the garbage bag B has been tied up one time, the compression plate 51 is rotated to release the fitting state.

After that, as shown in FIG. 6*g*, the compression plate 51 is removed in the state where the cover plate 130 has been removed. If the two tying portions B1 are tied up and the remaining two tying portions B2 are not tied up, first, a free space portion is formed through the two tying portions B2 not tied up yet. The compression plate 51 is twistedly moved in left and right sides in the free space portion and thus drawn from the garbage bag B. At this time, the compressed state of the waste can be maintained through the two tying portions B1 already tied up.

Finally, as shown in FIG. 6*h*, the remaining two tying portions B2 are tied up, and the garbage bag B is drawn from the body 110 of the wastebasket.

Next, as shown in FIG. 5*b*, a state will be explained wherein the garbage bag C having the tying string C1 is applied to the compression-type wastebasket of the present invention.

Figure 7:
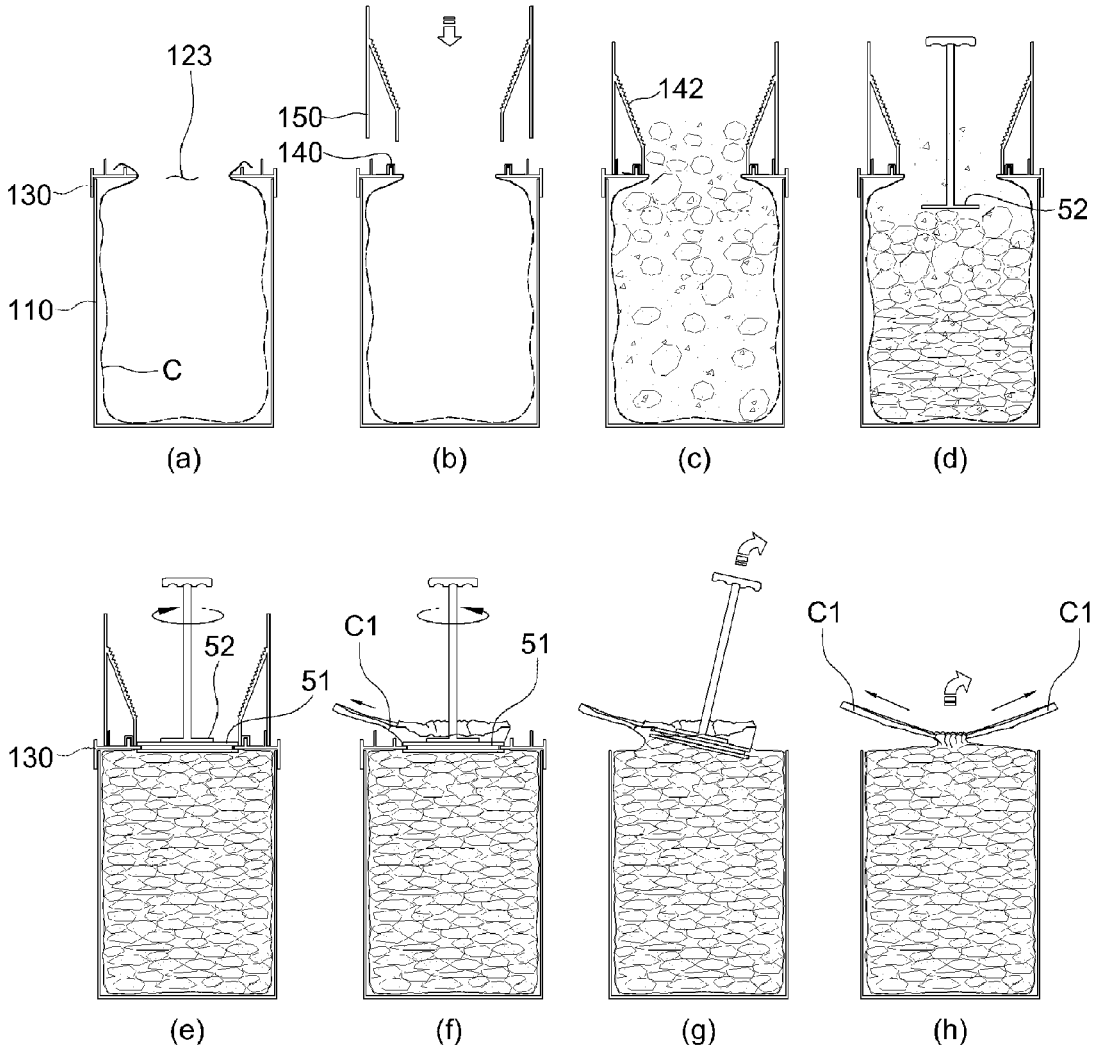
FIGS. 7*a* to 7*h* are sectional views showing the usage processes of the compression-type wastebasket according to the first embodiment of the present invention applied to the garbage bag of FIG. 5*b*.

When compared with the method for using the garbage bag B as mentioned above, the processes of FIGS. 7*a* to 7*e* are the same as those in the garbage bag B, but the processes of FIGS. 7*f*, 7*g* and 7*h* are different from those in the garbage bag B.

Referring to FIGS. 7*f*, 7*g* and 7*h*, therefore, the differences will be explained.

FIG. 7*f* shows the state where the upper casing 150 and the round fastening rim 140 are removed from the body 110 after the compression plate 51 has compressed the waste and next, the tying string C1 of the garbage bag C is somewhat pulled.

After that, as shown in FIG. 7*g*, the compression plate 51 is removed in the state where the cover plate 130 has been removed. Since the tying string C1 of the garbage bag C is somewhat pulled in FIG. 7*f*, a space portion exists on the inlet end portion of the garbage bag C, through which the compression plate 51 is escaped. Accordingly, the compression plate 51 is twistedly moved in left and right sides in the space portion and thus drawn from the garbage bag C. At this time, the compressed state of the waste can be maintained since the tying string C1 of the garbage bag C is somewhat pulled.

Finally, as shown in FIG. 7*h*, the tying string C1 is completely pulled to tie the inlet end portion of the garbage bag C and is tied up at both ends thereof. Next, the garbage bag C is drawn from the body 110 of the wastebasket.

Figure 8:
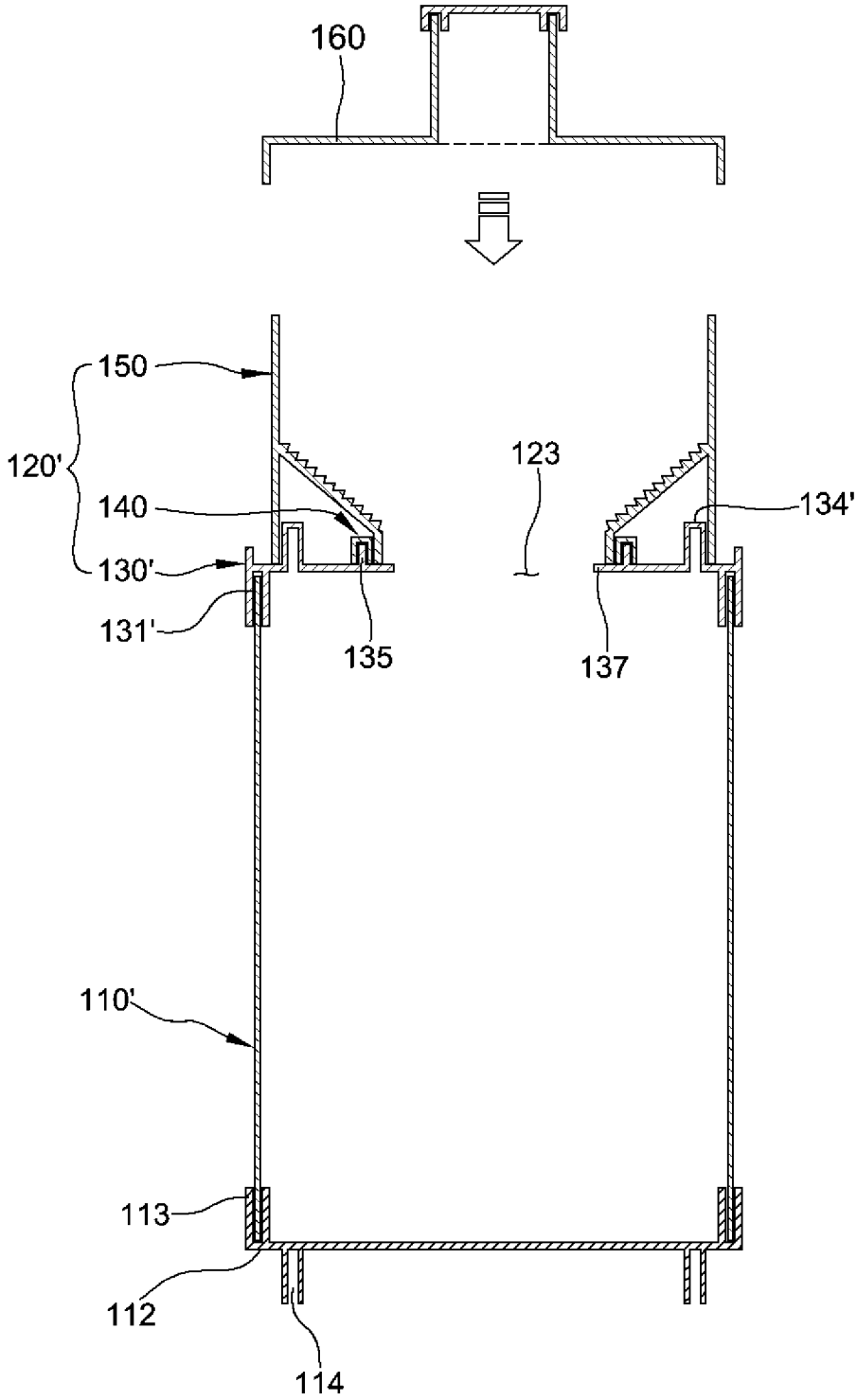
FIG. 8 is a sectional view showing one of the variations of the compression-type wastebasket according to the first embodiment of the present invention.

On the other hand, FIG. 8 shows one of the variations of the compression-type wastebasket according to the first embodiment of the present invention, wherein a relatively small capacity garbage bag can be mounted into the wastebasket.

FIG. 8 has a difference from the first embodiment of the present invention, in that the wastebasket is provided with an upper casing fixing protrusion 134', a body fixing rim 131' and a body base plate 112 separable from the underside of the body 110.

The upper casing fixing protrusion 134' is formed having an insertion groove along which a small capacity body is fitted, which serves to fix the small capacity body together with an insertion groove 114 formed on the underside of the body base plate 112.

The insertion groove 114 formed on the underside of the body base plate 112 has a round shape having a small diameter. Accordingly, if it is desired to use the small capacity body, the body base plate 112 is turned over to face the insertion groove of the upper casing fixing protrusion 134', and the body is then mounted.

Further, the body fixing rim 131' of a cover plate 130' has an insertion groove formed therealong so as to more stably support the body 110', and a groove 113 is formed along the corresponding portion of the body base plate 112 thereto.

Figure 9:
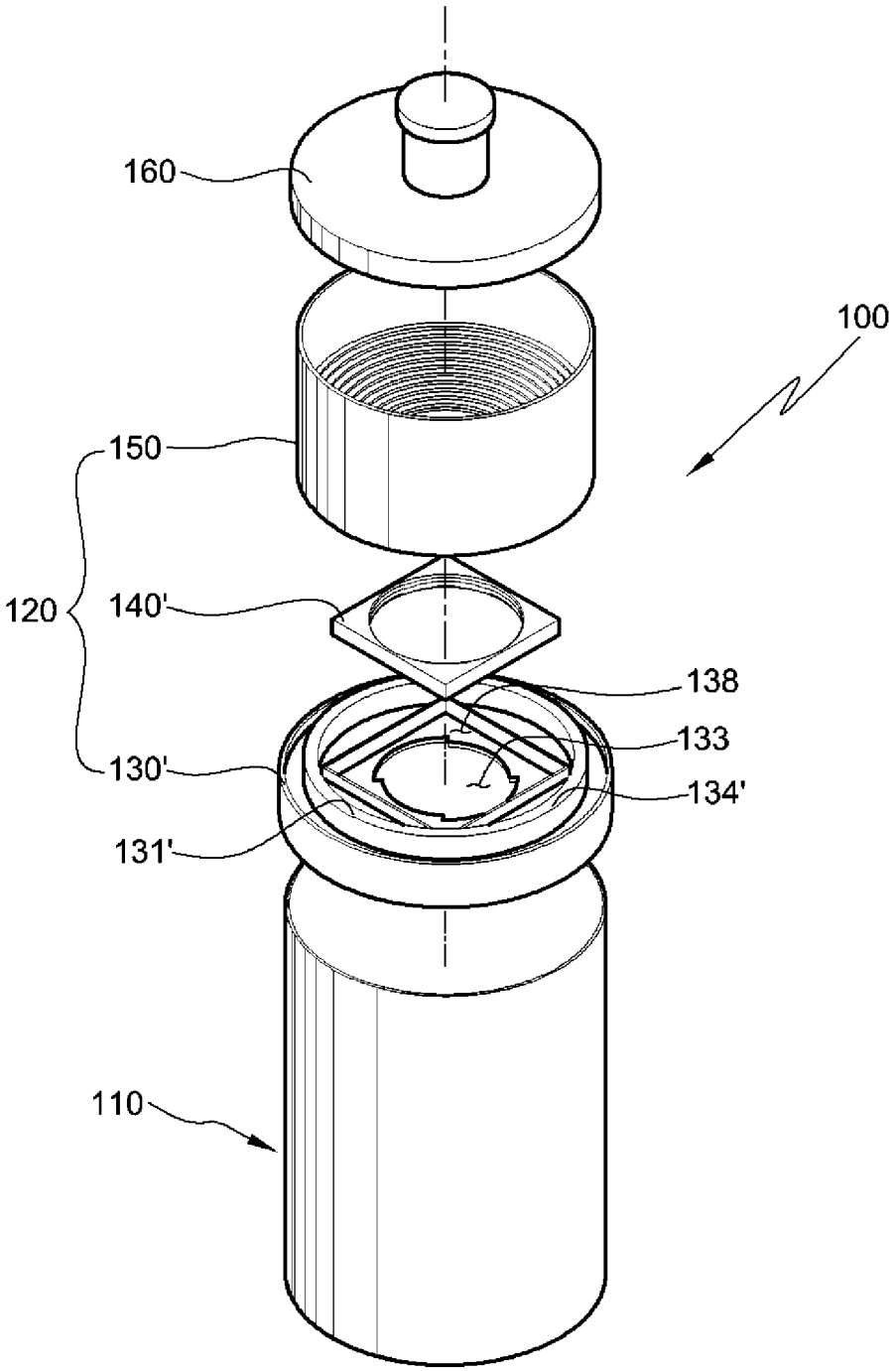
FIG. 9 is a perspective view showing another variation of the compression-type wastebasket according to the first embodiment of the present invention.
Figure 10:
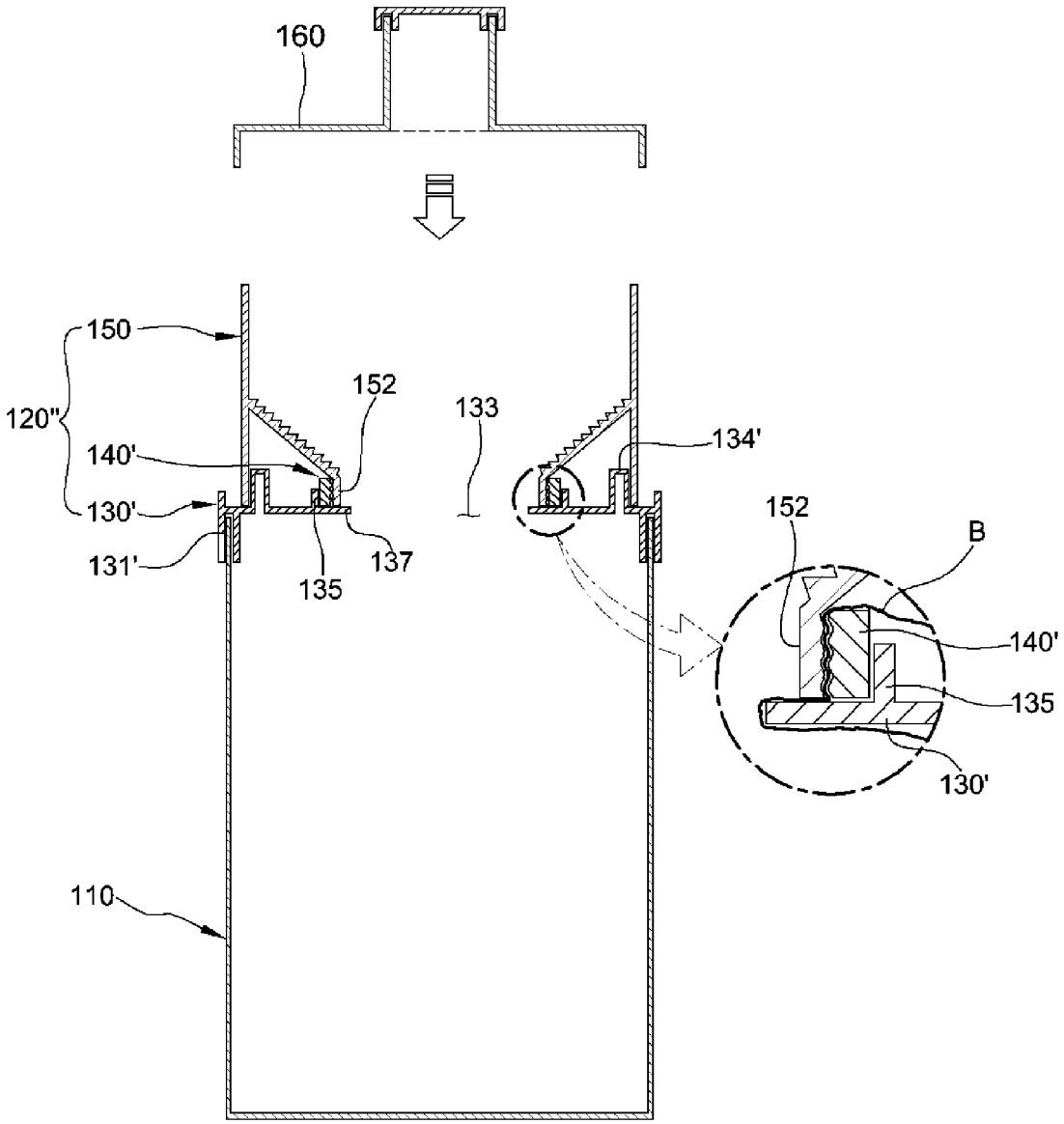
FIG. 10 is a sectional view showing the compression-type wastebasket of FIG. 9.

On the other hand, FIG. 9 is a perspective view showing another variation of the compression-type wastebasket according to the first embodiment of the present invention, and FIG. 10 is a sectional view showing the compression-type wastebasket of FIG. 9.

Referring to FIGS. 9 and 10, the round fastening rim 140 in the first embodiment of the present invention is not coupled to the bag fixing rim 135, but it is screw-coupled to the outer periphery of the lower portion of the guide casing portion 152. Further, the round fastening rim 140 in the first embodiment of the present invention becomes a fastening member 140' having an opening portion as a round through hole formed at the center thereof and a square or polygonal outer shape formed around the opening unit. Accordingly, the outer periphery of the lower portion of the guide casing portion 152 and the inner periphery of the fastening member 140' have spirals formed therealong, so that the guide casing portion 152 and the fastening member 140' are coupled to each other, and in the coupling state, the fastening member 140' is seated in a square seating space portion 138 formed on a cover plate 130'. The formation of the square seating space portion 138 permits the seating space portion 138 to be fixed to the fastening member 140, without any rotation together with the fastening member 140' when the guide casing portion 152 is separated from the fastening member 140' spirally-coupled thereto.

When the outer periphery of the lower portion of the guide casing portion 152 and the inner periphery of the fastening member 140' are spirally coupled to each other, in this variation, the inlet end portion of the garbage bag is fixedly fitted to the portion where the guide casing portion 152 and the fastening member 140' are spirally coupled to each other. In the fixed state, the garbage bag is normally used.

The above-mentioned fixing structure of the inlet end portion of the garbage bag B is different from that in the first embodiment of the present invention, but the other configurations and operations are the same as in the first embodiment of the present invention.

Next, an explanation on a compression-type wastebasket according to a second embodiment of the present invention will be given.

Figure 11:
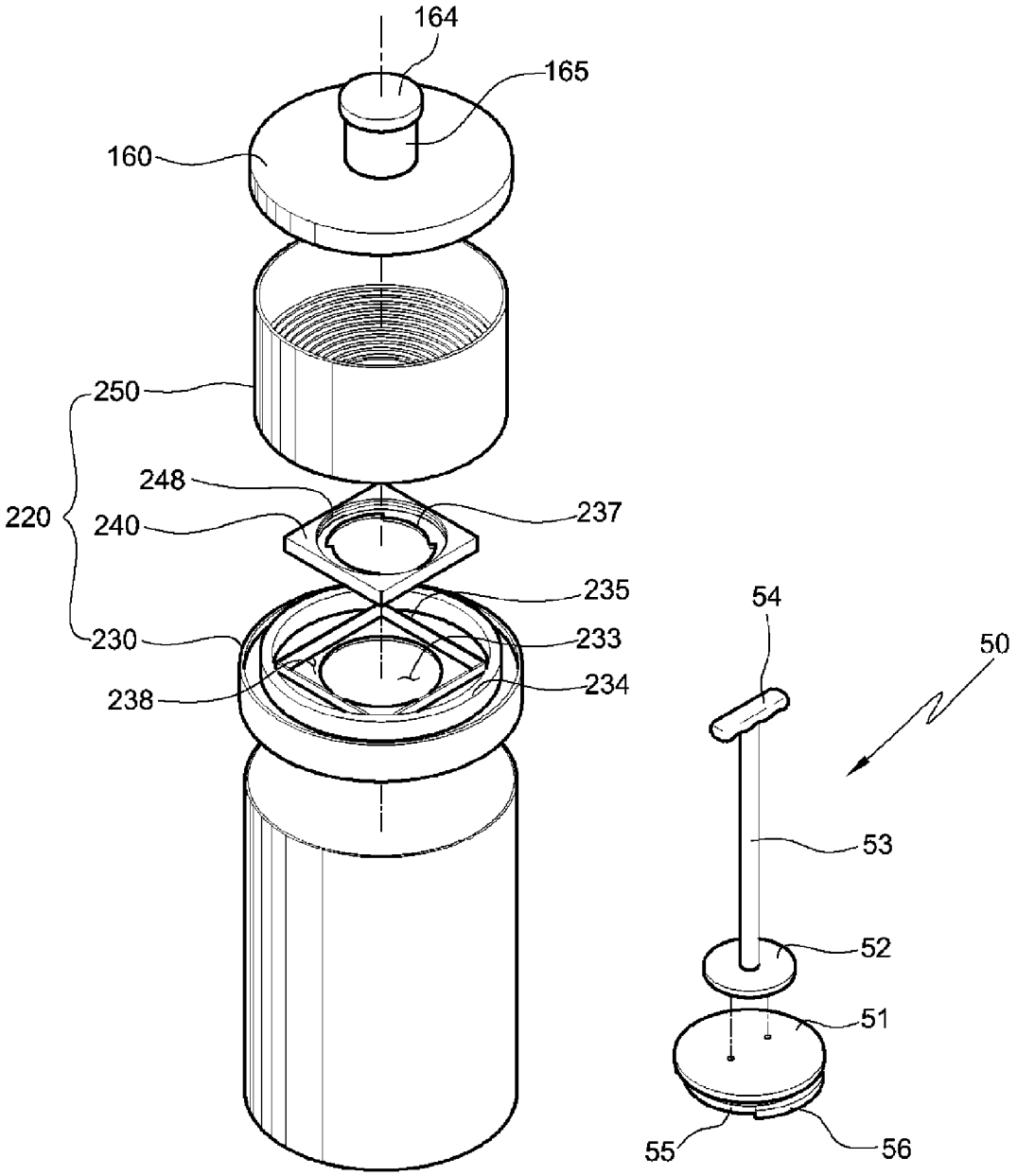
FIG. 11 is a perspective view showing a compression-type wastebasket according to a second embodiment of the present invention.
Figure 12:
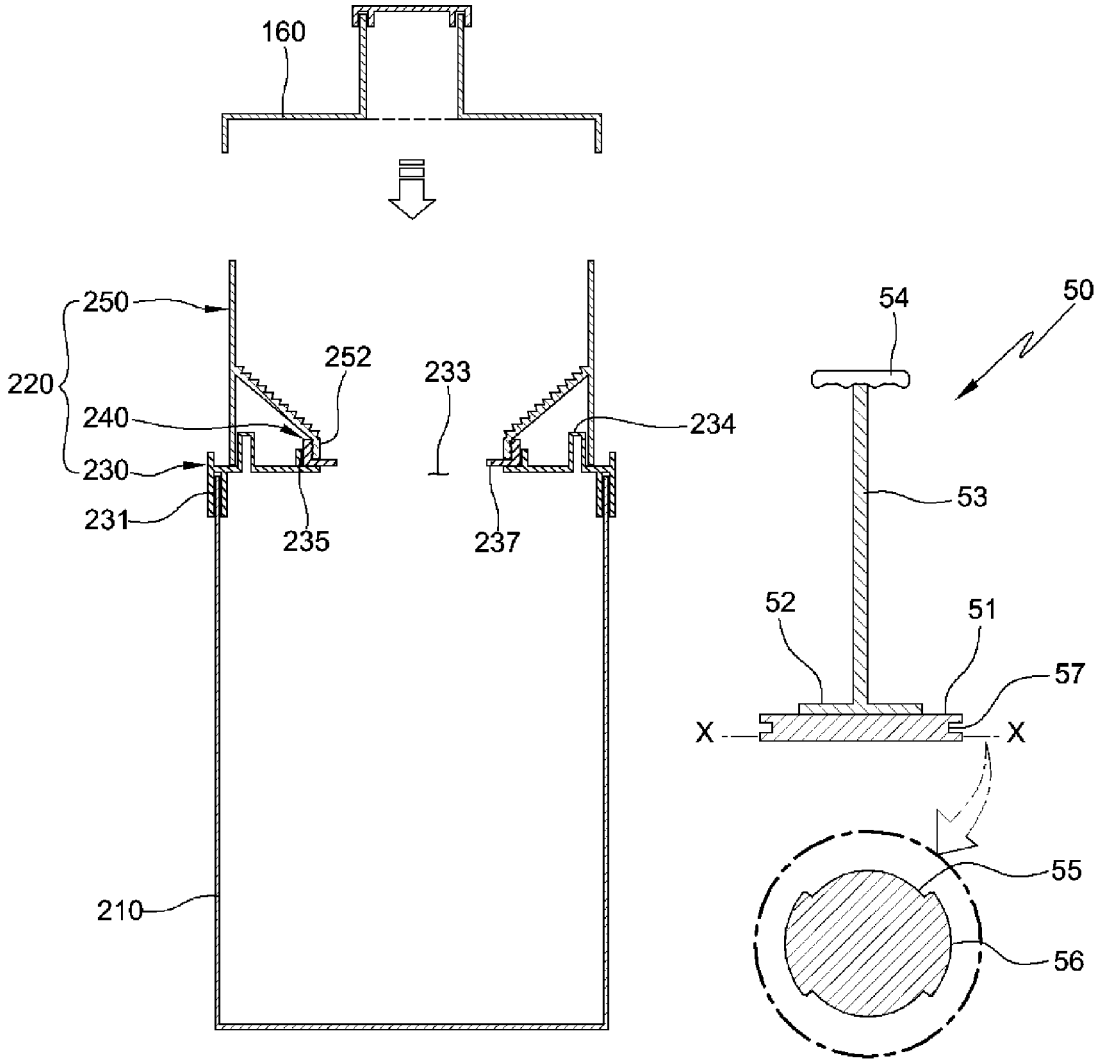
FIG. 12 is a sectional view showing the compression-type wastebasket according to the second embodiment of the present invention.

FIGS. 11 and 12 show the compression-type wastebasket according to the second embodiment of the present invention.

According to the second embodiment of the present invention, gripping protrusions 237 engaged with a compression means 50 are formed on a fastening member 240. Accordingly, a compression plate 51 of the compression means 50 is engaged with the gripping protrusions 237 of the fastening member 240.

The fastening member 240 is of a square shape, so that it can be seated into a square seating space portion 238, in the same manner as shown in FIGS. 9 and 10. Further, the fastening member 240 has a spiral portion 248 formed on the inner periphery thereof in such a manner as to be coupled to a spiral portion formed on the outer periphery of the lower portion of a guide casing portion 252 of an upper casing 250.

According to the second embodiment of the present invention, if it is desired to mount the garbage bag B, first, the fastening member 240 is seated into the square seating space portion 238 formed on a cover plate 230. After that, the inlet end portion of the garbage bag B is exposed to the outside through an opening unit 233 and well spreads out on the top surface of the fastening member 240. In this state, the guide casing portion 252 of the upper casing 250 is spirally-coupled to the fastening member 240, so that the inlet end portion of the garbage bag B is fixedly fitted to the portion where the guide casing portion 252 and the fastening member 240 are spirally-coupled to each other. Of course, after the guide casing portion 252 and the fastening member 240 are spirally coupled to each other to allow the inlet end portion of the garbage bag B to be located therebetween, the guide casing portion 252 and the fastening member 240 may be located into the square seating space portion 238.

Figure 13:
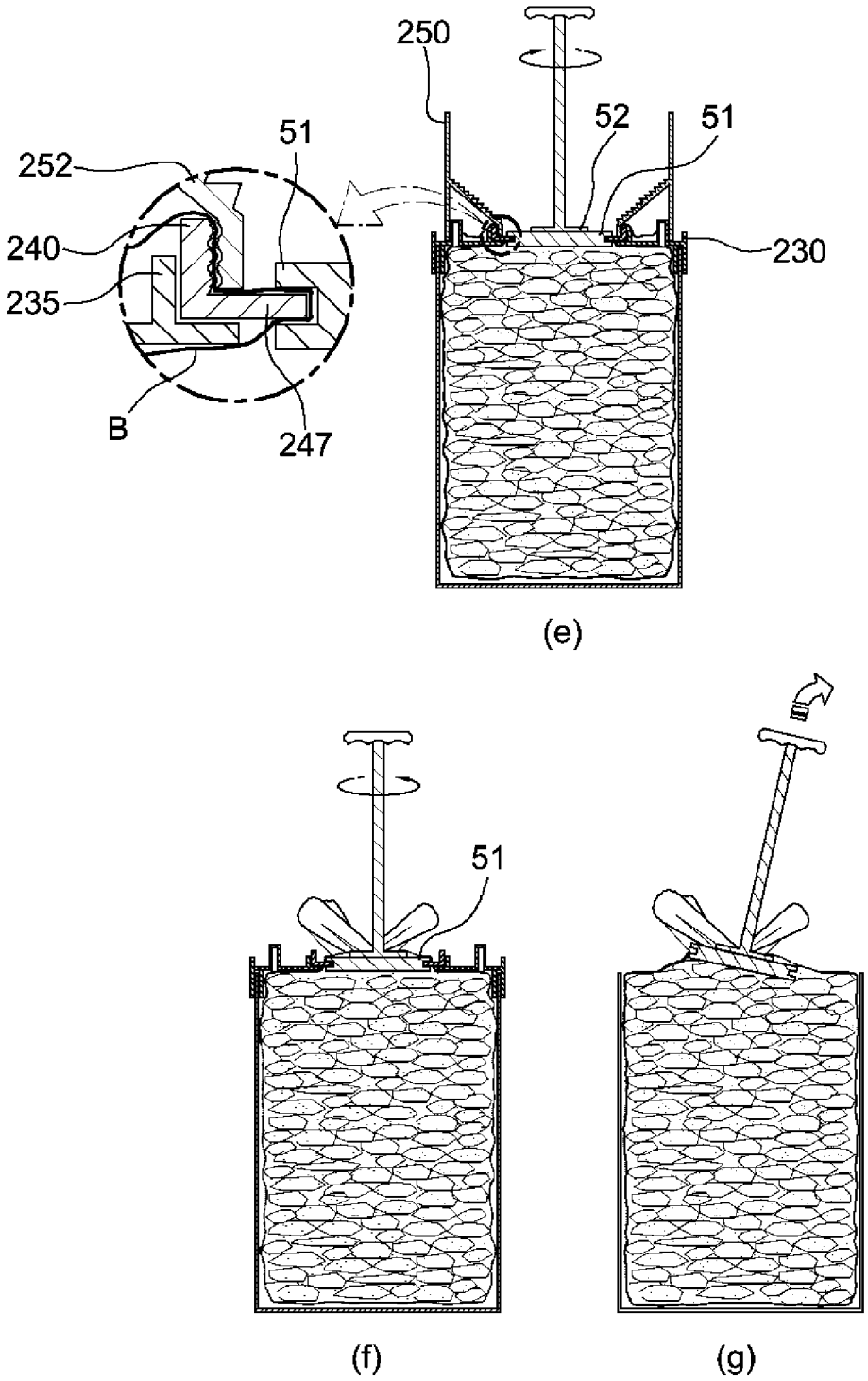
FIGS. 13*e* to 13*g* are sectional views showing the usage processes of the compression-type wastebasket according to the second embodiment of the present invention.

On the other hand, FIGS. 13*e* to 13*g* are sectional views showing a method for tying a garbage bag B through the compression-type wastebasket according to the second embodiment of the present invention. The figures show the processes corresponding to FIGS. 6*e* to 6*g*.

FIG. 13*e* shows the process where the compression plate 51 is rotated to a given angle with respect to a compressing direction in the state where the waste in the garbage bag B is compressed by means of the compression plate 51. Accordingly, the compression plate 51 is engaged with the gripping protrusions 247 of the fastening member 240. In this state, the inlet end portion of the garbage bag B is fixedly fitted between the gripping protrusions 247 of the fastening member 240 and the gripping grooves 57 of the compression plate 51.

After that, as shown in FIG. 13*f*, the upper casing 250 is rotated to permit the guide casing portion 252 to be separated from the spiral portion 248 of the fastening member 240. Even though the gripping state of the inlet end portion of the garbage bag B is released through the separation of the guide casing portion 252 from the fastening member 240, the lower portion of the inlet end portion of the garbage bag B is fixedly fitted between the gripping protrusions 247 of the fastening member 240 and the gripping grooves 57 of the compression plate 51. Accordingly, the inlet end portion of the garbage bag B is not escaped downwardly. After the upper casing 250 is separated, the two tying portions of the garbage bag B are tied up one time.

After that, as shown in FIG. 13*g*, the compression plate 51 is rotated to release the gripping state of the garbage bag B, and the compression plate 51 is twistedly moved in left and right sides in the free space portion formed through the two tying portions not tied up yet. Next, the two tying portions not tied up yet are tied up to get the garbage bag B out of the wastebasket.

Even if the garbage bag C as shown in FIG. 5*b* is used, the guide casing portion 252 is separated from the fastening member 240 to release the gripping state of the inlet end portion of the garbage bag C, so that the lower portion of the inlet end portion of the garbage bag C is fixedly fitted between the gripping protrusions 247 of the fastening member 240 and the gripping grooves 57 of the compression plate 51. In this case, accordingly, the processes as shown in FIGS. 7*e* to 7*g* are still carried out.

Figure 14:
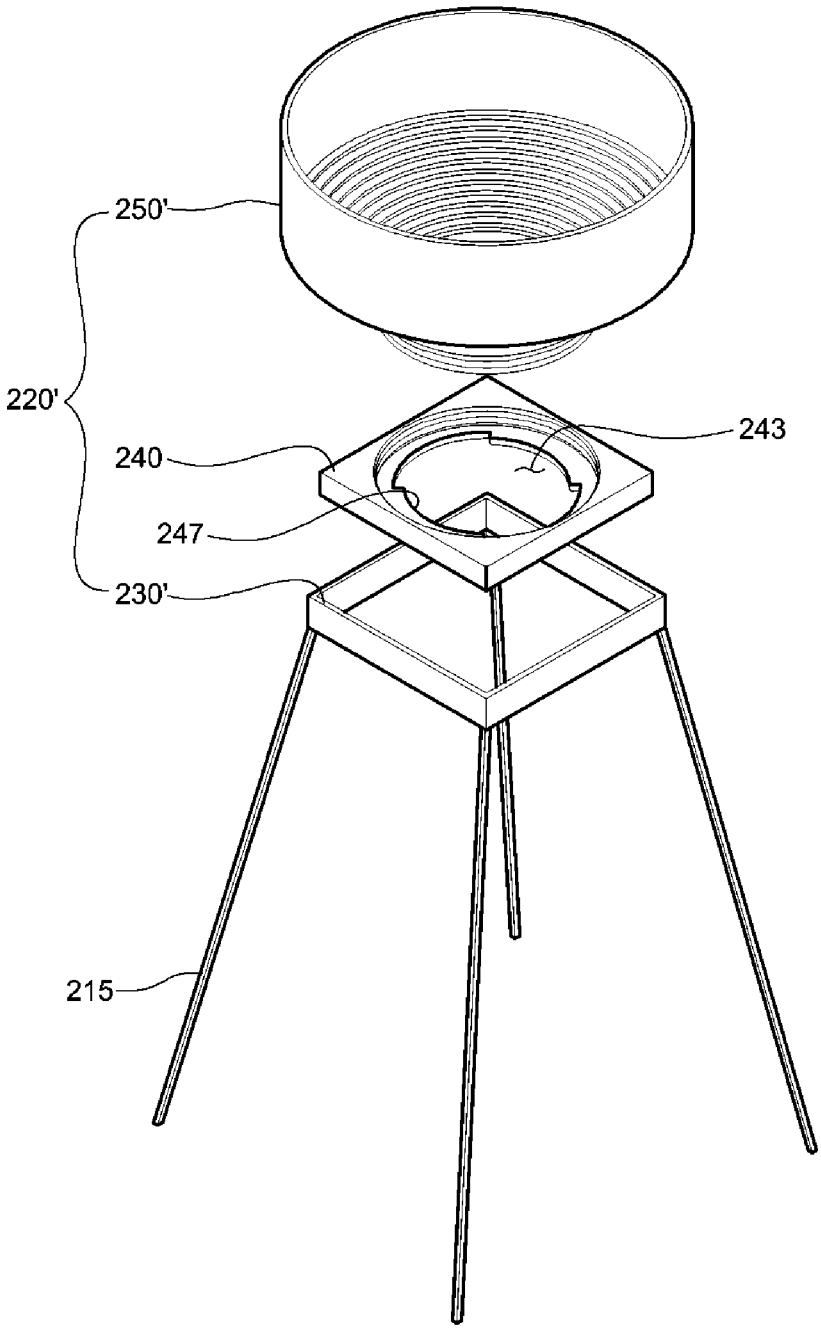
FIG. 14 is a perspective view showing one of variations of the compression-type wastebasket according to the second embodiment of the present invention.
Figure 15:
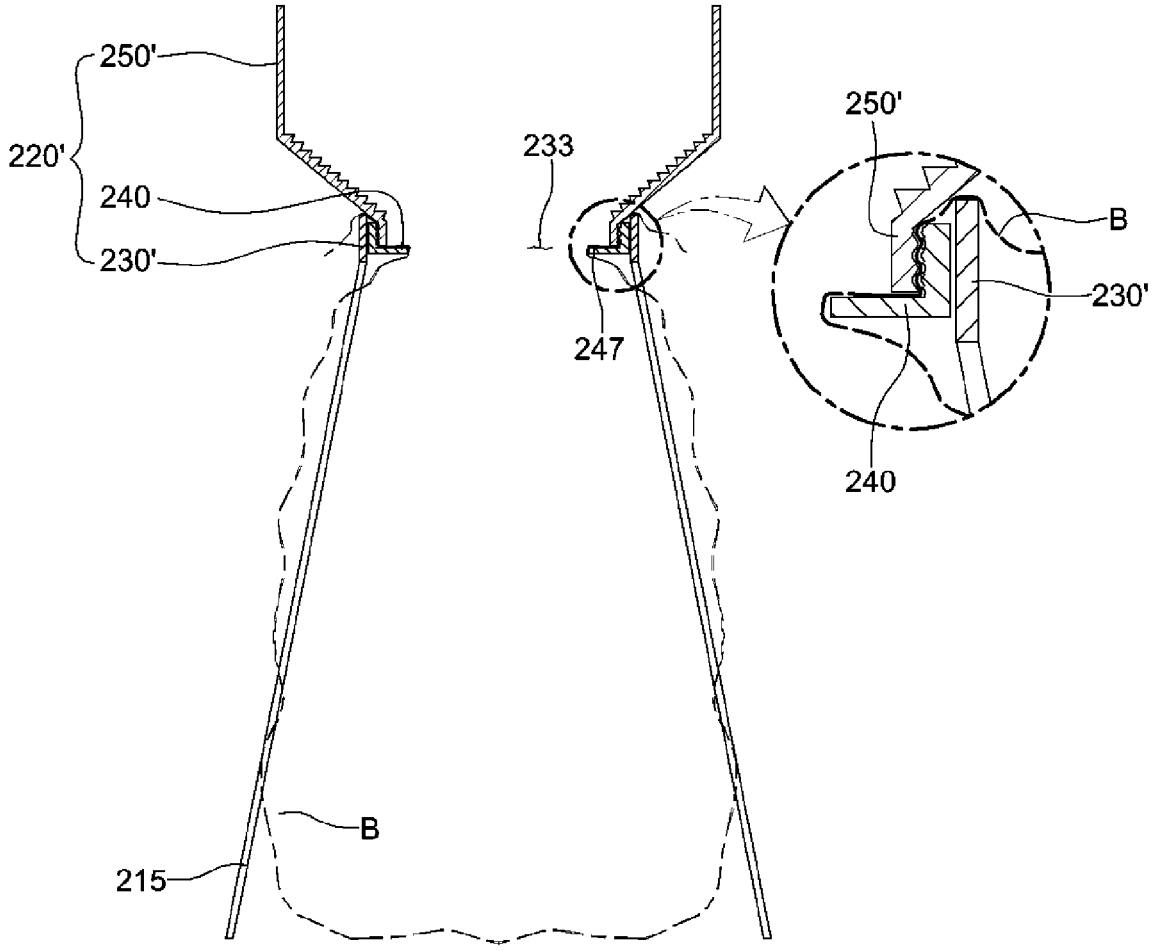
FIG. 15 is a sectional view showing the compression-type wastebasket of FIG. 14.

FIGS. 14 and 15 show one of variations of the compression-type wastebasket according to the second embodiment of the present invention.

In the variation, the body 210 is changed into a leg member 215, and a cover 220' includes a frame 230', a fastening member 240 seated into the frame 230', and an upper casing 250' spirally coupled to the fastening member 240. The fastening member 240 is the same as in the second embodiment of the present invention, and the upper casing 250' is formed by removing only the outside casing portion in the second embodiment of the present invention. The fastening member 240 and the upper casing 250' constitute the upper body in the variation of the second embodiment.

The frame 230' is of a square or polygonal shape, and the upper casing 250' to which the fastening member 240 is coupled is mounted supportedly on the frame 230'.

According to this variation, advantageously, the compression-type wastebasket becomes very simple in configuration.

The methods for mounting the garbage bag B and removing the garbage bag B in the state where the waste is compressed are the same as those in the second embodiment of the present invention.

Next, an explanation on a compression-type wastebasket according to a third embodiment of the present invention will be given.

Figure 16:
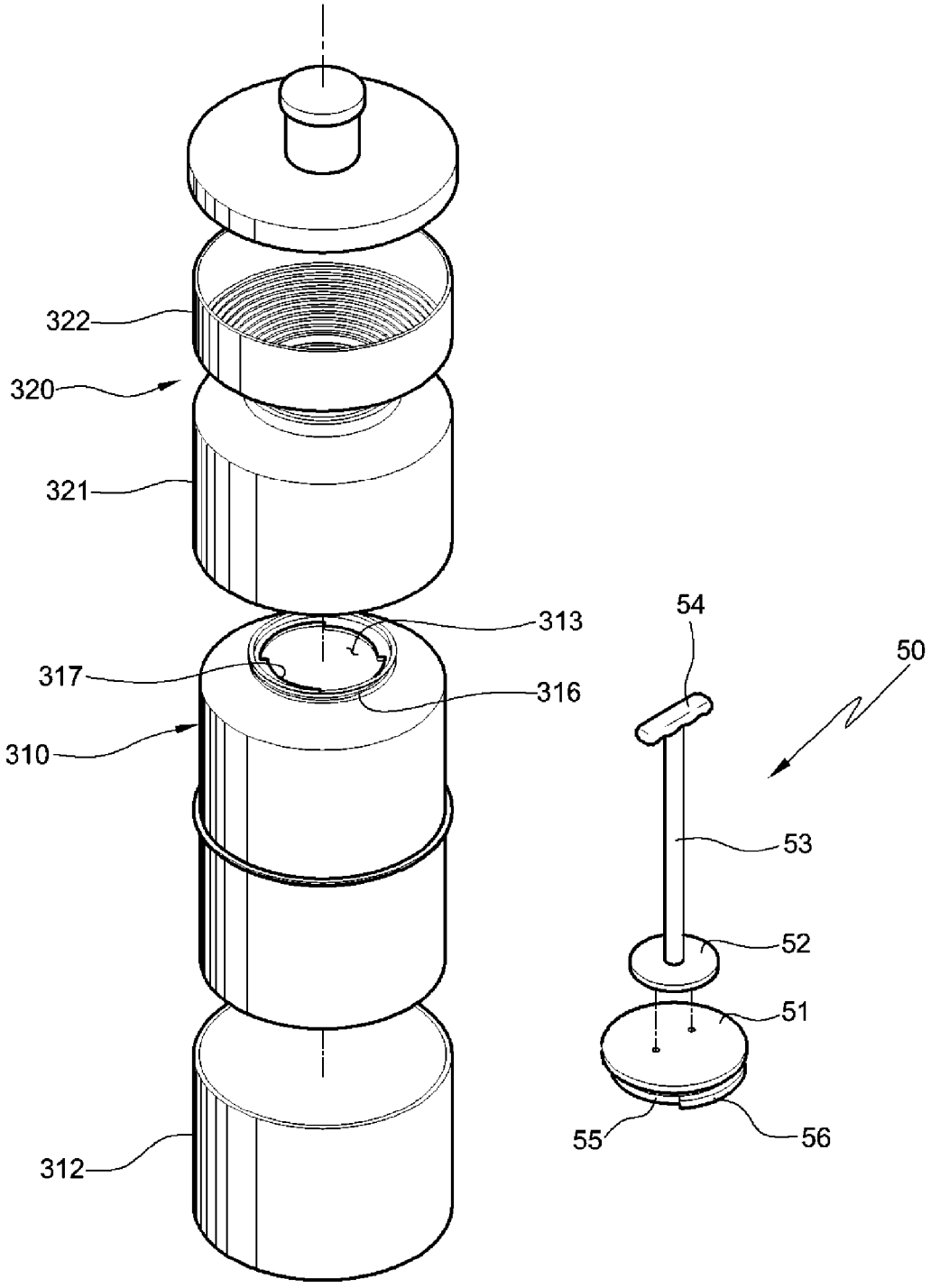
FIG. 16 is a perspective view showing a compression-type wastebasket according to a third embodiment of the present invention.
Figure 17:
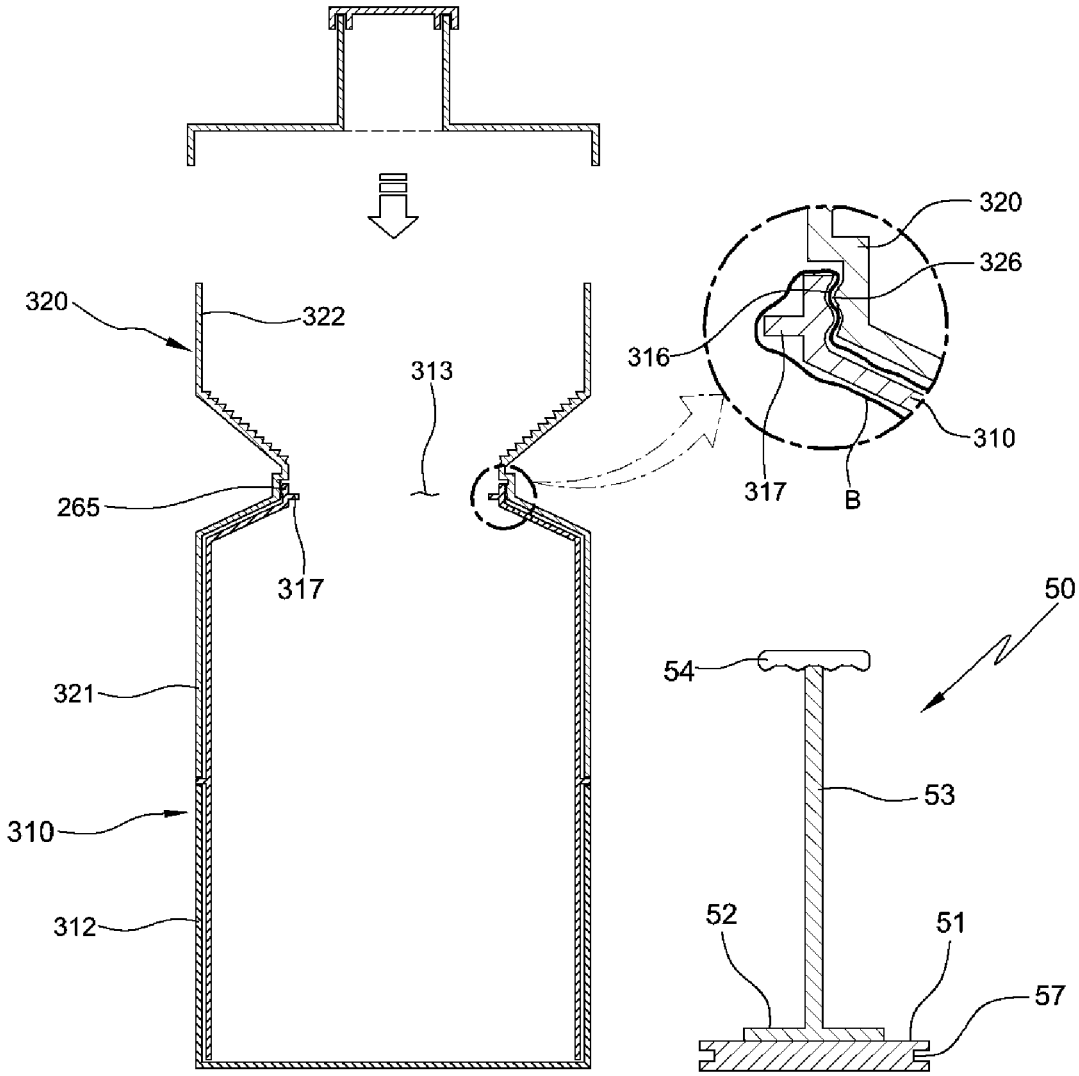
FIG. 17 is a sectional view showing the compression-type wastebasket according to the third embodiment of the present invention.

FIGS. 16 and 17 show the compression-type wastebasket according to the third embodiment of the present invention. According to the third embodiment of the present invention, the gripping protrusions 317 engaged with the gripping grooves 57 of the compression plate 51 are formed on a body 310.

The body 310 becomes concavedly small on the upper portion thereof to form an opening unit 313, so that the garbage bag B located at the inside of the body 310 cannot be drawn upwardly. Accordingly, so as to draw the garbage bag B after used from the lower portion of the body 310, the body 310 is open at the lower portion thereof. The open lower portion of the body 310 is closed by means of a base casing 312.

The cover 320 includes a guide casing portion 322 and a cover casing portion 321 located under the guide casing portion 322, and further has a concave waist portion formed between the guide casing portion 322 and the cover casing portion 321.

The waist portion of the cover 320, that is, the concave portion formed by connecting the guide casing portion 322 and the cover casing portion 321 has a spiral portion 326 formed thereon in such a manner as to be coupled to a spiral portion 316 formed on the outer periphery of the top end portion of the body 310. Accordingly, the cover 310 and the body 310 are spirally coupled to each other at the waist portion of the cover 320.

Further, in the spirally coupled portion between the cover 320 and the body 310, as shown in the enlarged portion of FIG. 17, the inlet end portion of the garbage bag B is fixedly fitted between the spiral portion 326 of the cover 320 and the spiral portion 316 of the body 310. Accordingly, when the compression-type wastebasket according to the third embodiment of the present invention is normally used, the inlet end portion of the garbage bag B is used in the state of being fixed thereto.

The cover casing portion 321 is adapted to cover the upper portion of the body 310, while covering the exposed portion of the garbage bag B located between the body 310 and the cover casing portion 321, thereby providing a good outer appearance of the compression-type wastebasket.

According to the third embodiment of the present invention, in the same manner as above, in the state where the gripping grooves 57 of the compression plate 51 are engaged with the gripping protrusions 317 of the body 310, the garbage bag B can be tied up. That is, in the state where the compression plate 51 is engaged with the body 310, the cover 320 is rotated to release the spiral coupling with the body 310, and thus, the cover 320 is removed. After that, two tying portions of the garbage bag B are tied up. Next, the compression plate 51 is rotated to release the gripping state and then removed. Further, the remaining two tying portions are tied up, and the base casing 312 of the body 310 is removed to draw the garbage bag B from the body 310.

Figure 18:
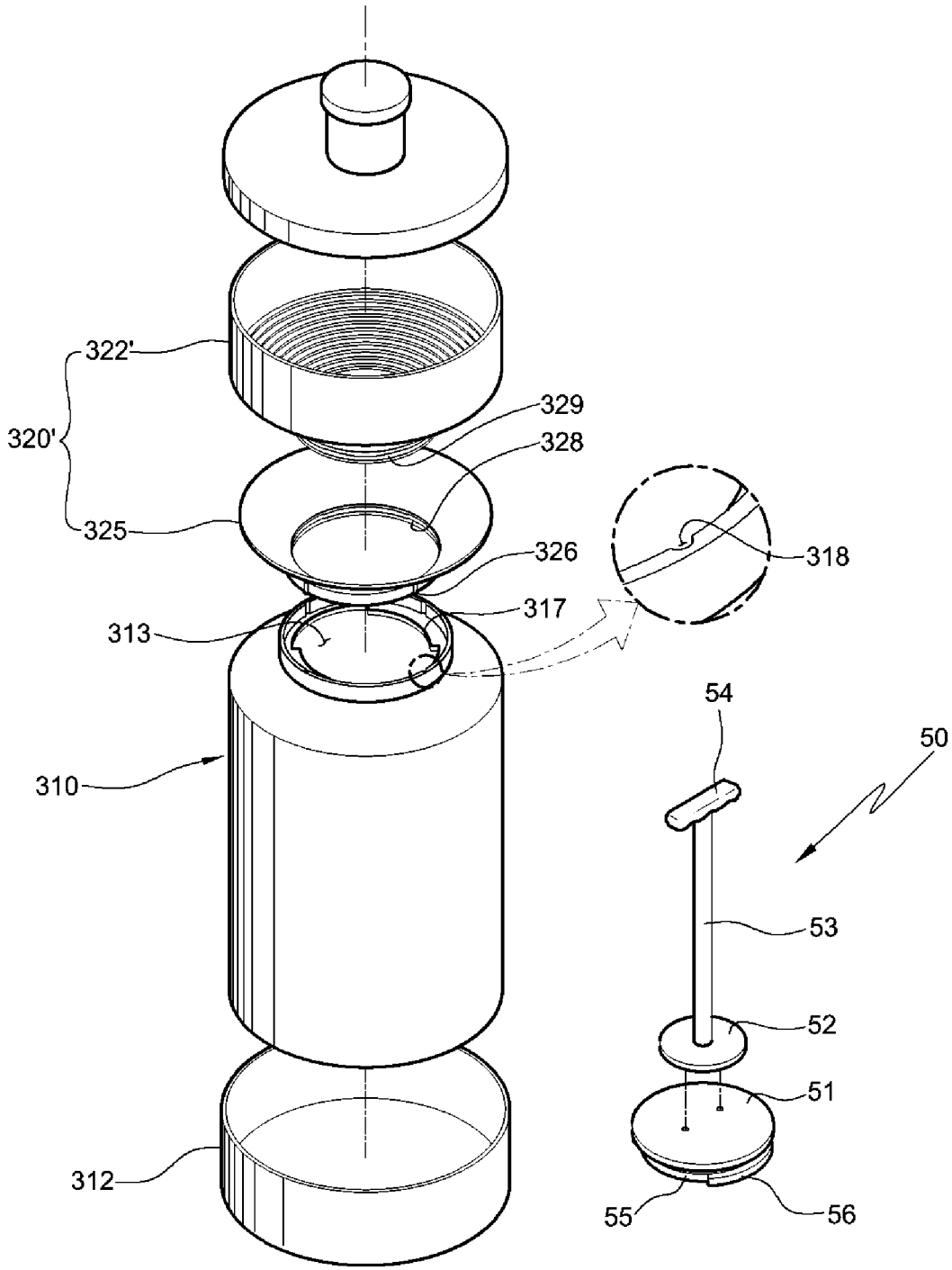
FIG. 18 is a perspective view showing one of variations of the compression-type wastebasket according to the third embodiment of the present invention.
Figure 19:
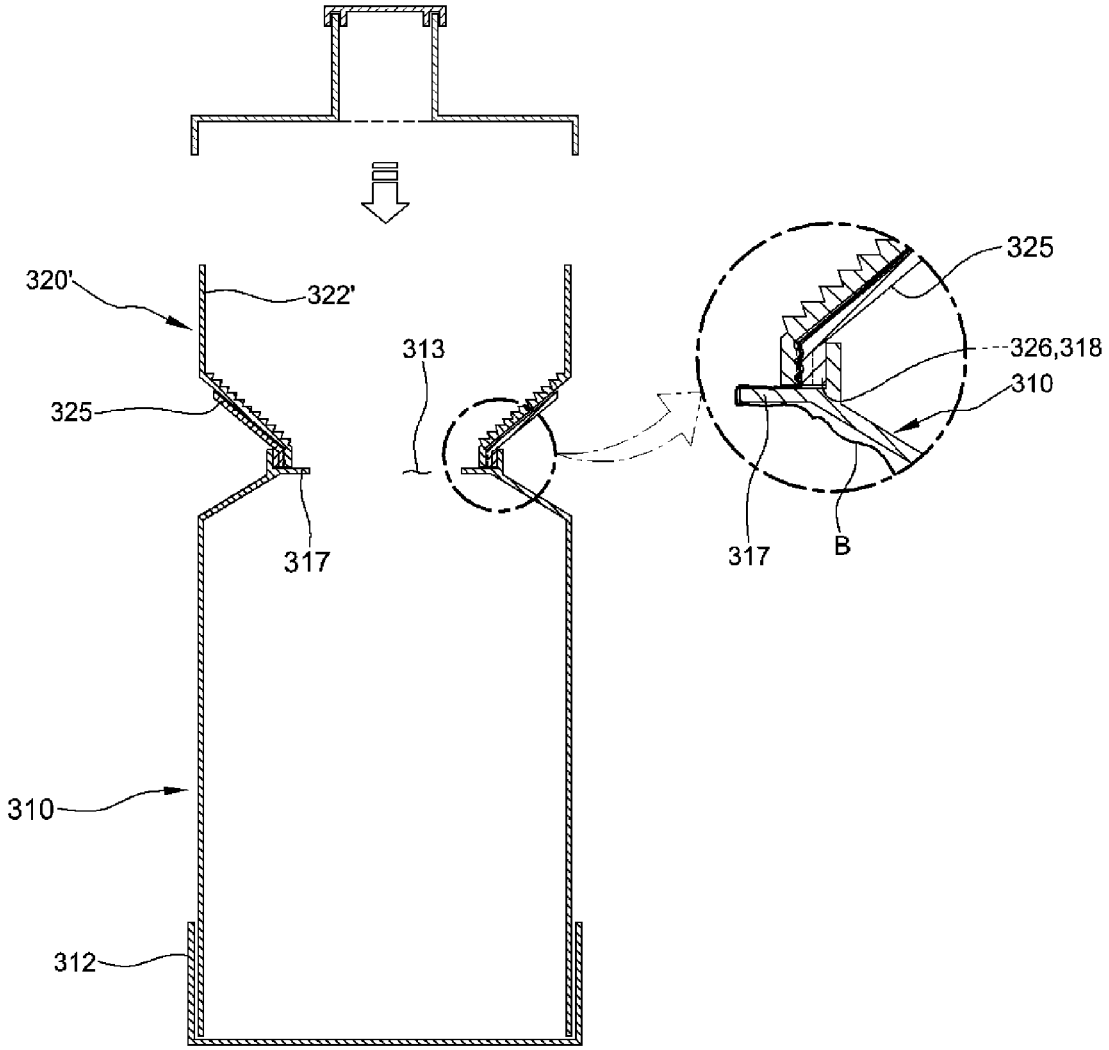
FIG. 19 is a sectional view showing the compression-type wastebasket of FIG. 18.

FIGS. 18 and 19 show one of variations of the compression-type wastebasket according to the third embodiment of the present invention.

In this variation, a cover 320' has a separate fastening member 325 located between a guide casing portion 322' and the body 310, and a spiral portion 328 of the fastening member 325 is spirally coupled to a spiral portion 329 of the guide casing portion 322'. As shown in the enlarged portion of FIG. 19, at the time when the spiral portions 328 and 329 are spirally coupled to each other, the inlet end portion of the garbage bag B is fixedly fitted between the spiral portions 328 and 329.

In the state where the fastening member 325 and the guide casing portion 322' are spirally coupled to each other to allow the inlet end portion of the garbage bag B is fixedly fitted between the spiral portions 328 and 329, they are seated on the upper portion of the body 310. At this time, fixing grooves 318 are formed along the top periphery of the body 310 in such a manner as to insert fixing protrusions 326 of the fastening member 325 thereinto. Accordingly, the fastening member 325 can be stably fixed, and in the process where the guide casing portion 322' spirally coupled to the fastening member 325 is rotated and removed, the fastening member 325 can be maintained in the fixed state to the body 310.

The fastening member 325 becomes gradually enlarged to surround the lower portion of the guide casing portion 322'. Accordingly, the inlet end portion of the garbage bag B is located between the lower portion of the guide casing portion 322' and the gradually enlarged portion of the fastening member 325, thereby preventing the garbage bag B from being exposed to the outside.

In this variation, the gripping protrusions 317 are formed on the opening unit 313 of the body 310, and the method for using the compression-type wastebasket is the same as the above-mentioned embodiments.

Figure 20:
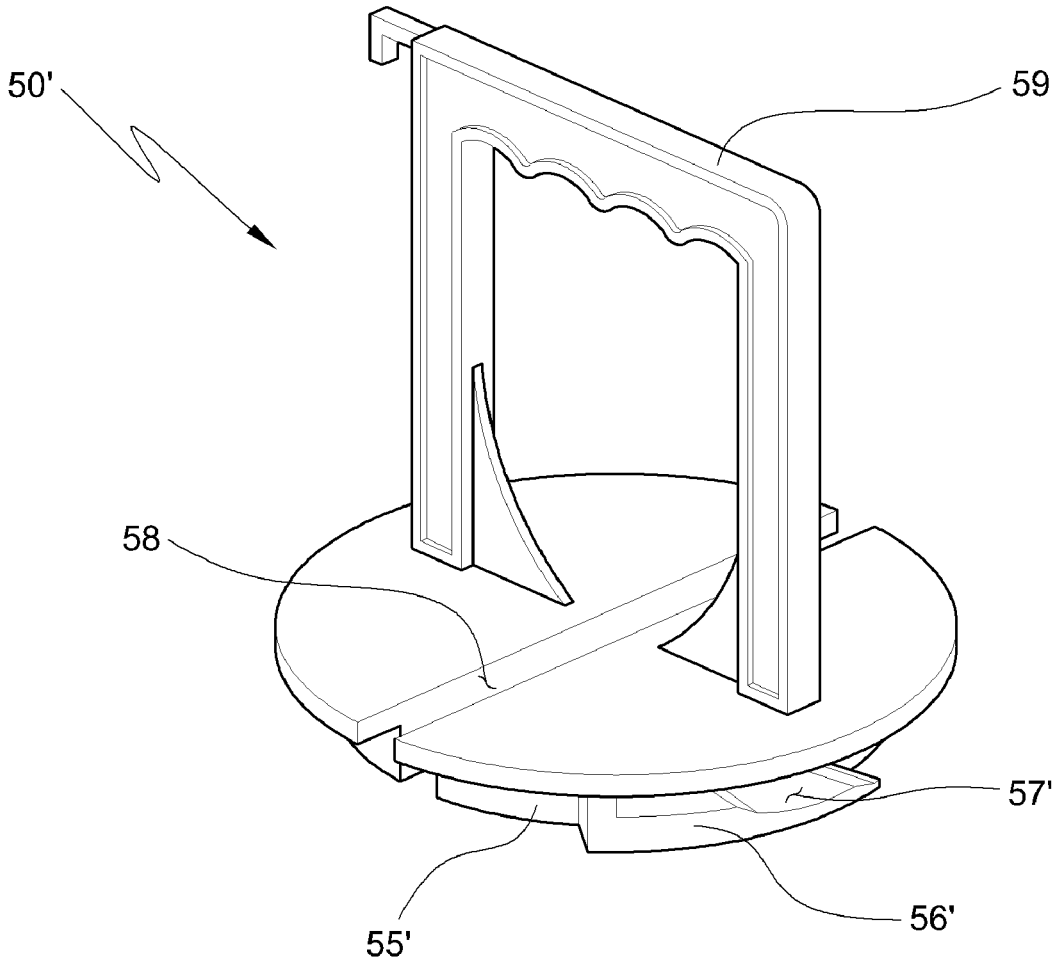
FIG. 20 is a perspective view showing one of variations of the compression means in the compression-type wastebasket according to the third embodiment of the present invention.

On the other hand, FIG. 20 is a perspective view showing one of variations of the compression means in the compression-type wastebasket according to the third embodiment of the present invention.

In this variation, a compression means 50' has semi-circular both side portions separated by means of a cutting portion 58 having a given with formed in the middle portion thereof. The semi-circular both side portions are fixed rigidly by means of a support member 59 disposed on the top surfaces thereof. Accordingly, the given width of the cutting portion 58 can be always maintained constantly. The support member 59 also serves as a handle taken by a user's hand. Further, gripping grooves 57' are formed correspondingly on the semicircular both side portions of the compression means 50', thereby gripping the inlet end portion of the garbage bag.

In case of using such compression means 50', the two tying portions B1 of the four tying portions of the garbage bag as shown in FIG. 5*a* are located at both end portions of the cutting portion 58, and the remaining two tying portions B2 are located at both side portions where the gripping grooves 57' are formed, thereby fixing the garbage bag B.

If it is desired to tie the garbage bag up to remove the garbage bag B from the compression-type wastebasket, in the same manner as in the above-mentioned embodiments, the gripping protrusions are engaged with the gripping grooves 57' of the compression means 50'. After that, the two tying portions B1 located at both sides of the cutting portion 58 pull and move toward each other along the cutting portion 58, and next, they are tied up under the support member 59. Accordingly, the tying portions B1 are rigidly tied up, and the tying operation can be easily carried out even in the state where the waste in the garbage bag B is excessively charged.

After that, the compression means 50' is rotated and removed, and the remaining two tying portions B2 are tied up.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The compression-type wastebasket according to the present invention is capable of efficiently charging waste into the garbage bag mounted thereinto, thereby enhancing the utilization of the garbage bag, and therefore, the compression-type wastebasket can be used in various places like houses, offices and so on.

What is claimed is:

1. A compression-type wastebasket comprising:

a body having a space formed therein to accommodate a garbage bag into the space through an open upper end of the body;

a cover adapted to cover the upper portion of the body and having an opening unit formed at the center thereof in such a manner as to allow the inside of the body to communicate with the outside, a bag fixing unit formed along the outer periphery of the opening unit to fix the periphery of the inlet end portion of the garbage bag, and a gripping unit formed on a portion of the opening unit; and a compression member having a compression surface adapted to freely enter the opening unit to compress the waste charged into the garbage bag, the compression member adapted to be engaged with the gripping unit when rotated to a given angle around a compression direction on the opening unit.

2. The compression-type wastebasket according to claim 1, wherein the gripping unit is formed of gripping protrusions protruded toward the center of the opening unit from the portions of the inner periphery of the opening unit, and the compression member has gripping grooves into which the gripping protrusions are fittedly inserted, thereby being engaged with the gripping unit.

3. The compression-type wastebasket according to claim 1, wherein the gripping unit is formed of gripping grooves formed on the portions of the inner periphery of the opening unit, and the compression member has gripping protrusions adapted to be fittedly inserted into the gripping grooves, thereby being engaged with the gripping unit.

4. The compression-type wastebasket according to claim 1, wherein the bag fixing unit comprises:

a round bag fixing rim protruded from the outer periphery of the opening unit; and a round fastening rim adapted to be fastened to the bag fixing rim in such a manner as to fix the periphery of the inlet end portion of the garbage bag thereto.

5. The compression-type wastebasket according to claim 1, wherein the cover comprises:

a cover plate mounted on the upper side of the body; and an upper casing mounted on the upper side of the cover plate.

6. The compression-type wastebasket according to claim 5, wherein the bag fixing unit comprises:

a portion of the upper casing; and a fastening member adapted to be fastened to the portion of the upper casing.

7. The compression-type wastebasket according to claim 6, wherein the fastening member is fastened to the portion of the upper casing by means of spiral coupling.

8. A compression-type wastebasket comprising:

a frame;

an upper body adapted to be mounted on the frame and having an opening unit formed at the center thereof, a bag fixing unit formed along the outer periphery of the opening unit to fix the periphery of the inlet end portion of a garbage bag, and a gripping unit formed on a portion of the opening unit; and a compression member having a compression surface adapted to freely enter the opening unit to compress the waste charged into the garbage bag, the compression member adapted to be engaged with the gripping unit when rotated to a given angle around a compression direction on the opening unit.

9. The compression-type wastebasket according to claim 8, wherein the gripping unit is formed of gripping protrusions protruded toward the center of the opening unit from the portions of the inner periphery of the opening unit, and the compression member has gripping grooves into which the gripping protrusions are fittedly inserted, thereby being engaged with the gripping unit.

10. The compression-type wastebasket according to claim 8, wherein the gripping unit is formed of gripping grooves formed on the portions of the inner periphery of the opening unit, and the compression member has gripping protrusions adapted to be fittedly inserted into the gripping grooves, thereby being engaged with the gripping unit.

11. The compression-type wastebasket according to claim 8, wherein the upper body has an upper casing, and the bag fixing unit comprises: one end periphery of the upper casing; and a fastening member coupled to the one end periphery of the upper casing.

12. A compression-type wastebasket comprising:

a body having a space formed therein to accommodate a garbage bag thereinto, an opening unit formed on the upper portion thereof, and a gripping unit formed along a portion of the opening unit;

a cover having a shape of a casing communicating with the opening unit in such a manner as to cover the upper portion of the body and having a bag fixing unit adapted to be fastened to the periphery of the opening unit to fix the periphery of the inlet end portion of the garbage bag; and a compression member having a compression surface adapted to freely enter the opening unit to compress the waste charged into the garbage bag, the compression member adapted to be engaged with the gripping unit when rotated to a given angle around a compression direction on the opening unit.

13. The compression-type wastebasket according to claim 12, wherein the gripping unit is formed of gripping protrusions protruded toward the center of the opening unit from the portions of the inner periphery of the opening unit, and the compression member has gripping grooves into which the gripping protrusions are fittedly inserted, thereby being engaged with the gripping unit.

14. The compression-type wastebasket according to claim 12, wherein the gripping unit is formed of gripping grooves formed on the portions of the inner periphery of the opening unit, and the compression member has gripping protrusions adapted to be fittedly inserted into the gripping grooves, thereby being engaged with the gripping unit.

15. The compression-type wastebasket according to claim 13, wherein the portions where the gripping protrusions and the gripping grooves are engaged with each other are formed in pairs at the positions facing each other.

16. The compression-type wastebasket according to claim 12, wherein the compression member has both side semi-circular portions separated by means of a cutting portion having a given width, and the semi-circular both side portions are fixed rigidly by means of a support member disposed on the top surfaces thereof in such a manner as to be engaged at both sides thereof with the gripping unit.

* * * * *